US012426709B1

(12) United States Patent
Berkowitz

(10) Patent No.: US 12,426,709 B1
(45) Date of Patent: Sep. 30, 2025

(54) APPARATUS AND METHOD FOR RELEASABLY LOCKED FURNITURE

(71) Applicant: Jay A. Berkowitz, Penn Valley, PA (US)

(72) Inventor: Jay A. Berkowitz, Penn Valley, PA (US)

( * ) Notice: Subject to any disclaimer, the term of this patent is extended or adjusted under 35 U.S.C. 154(b) by 0 days.

(21) Appl. No.: 19/065,389

(22) Filed: Feb. 27, 2025

Related U.S. Application Data

(63) Continuation-in-part of application No. 18/830,134, filed on Sep. 10, 2024, now Pat. No. 12,262,812.

(51) Int. Cl.
*A47B 96/06* (2006.01)

(52) U.S. Cl.
CPC ..... *A47B 96/061* (2013.01); *A47B 2230/01* (2013.01); *A47B 2230/07* (2013.01)

(58) Field of Classification Search
CPC ... A47B 96/021; A47B 96/028; A47B 96/061; A47B 57/40; A47B 57/42; A47B 2230/01; A47B 2230/07; A47F 5/0043; A47F 5/103; A47F 5/0018
See application file for complete search history.

(56) References Cited

U.S. PATENT DOCUMENTS 529,747 A 11/1894 Perrody
593,828 A 11/1897 Ank
738,847 A 9/1903 Rummel
1,894,145 A 1/1933 Andler
4,198,913 A 4/1980 Haworth et al.
4,222,542 A * 9/1980 Wilson ..... A47B 57/42 312/263
4,660,477 A 4/1987 Kortering et al.
(Continued)

FOREIGN PATENT DOCUMENTS

CN 109222407 A 1/2019
CN 111109842 A 5/2020
(Continued)

OTHER PUBLICATIONS

Dual-Trak Shelf System, Knape & Vogt, © 2017, retrieved on Sep. 10, 2024 from https://www.knapeandvogt.com/sites/default/files/OL2309-DT-ShelfSystems-SS-WEB.pdf.

*Primary Examiner* — Daniel J Wiley
(74) *Attorney, Agent, or Firm* — Caesar Rivise, PC

(57) ABSTRACT

An apparatus and method for releasably lockable furniture. The apparatus includes a receptable bracket having a plurality of chambers on one furniture component and a corresponding plurality of projections on a second furniture component. A release device having a release button is included with the receptacle bracket while a cavity, configured for receiving that release button therein, is formed into a region where the plurality of projections is present. To connect the components, the projections are inserted into the corresponding chambers and two components are slid in opposite direction so that the release button is seated in the cavity, thereby releasably locking the two components together. Additional receptacle brackets with the release device can be provided on the first component and additional plurality of projections with the cavity can be provided on the second component. To disassemble, the release button(s) are depressed and the two components moved in opposite directions.

27 Claims, 33 Drawing Sheets

(56) References Cited

U.S. PATENT DOCUMENTS

| | | | | |
|---|---|---|---|---|
| 4,791,873 | A | 12/1988 | Towfigh | |
| 4,886,236 | A | 12/1989 | Randall | |
| 5,340,209 | A | 8/1994 | Kolbe et al. | |
| 5,348,385 | A | 9/1994 | Berg | |
| 5,405,114 | A | 4/1995 | Dias | |
| 5,720,230 | A | 2/1998 | Mansfield | |
| 5,735,589 | A | 4/1998 | Herrmann et al. | |
| 5,918,422 | A | 7/1999 | Bucher, Jr. | |
| 5,970,887 | A | 10/1999 | Hardy | |
| 6,019,331 | A | 2/2000 | Hoogland et al. | |
| 6,457,790 | B1 | 10/2002 | Liang et al. | |
| 6,591,762 | B1 | 7/2003 | Haghayegh | |
| 6,799,523 | B1 | 10/2004 | Cunha | |
| 7,255,236 | B1 | 8/2007 | Sauder et al. | |
| 7,258,317 | B1 | 8/2007 | Nagel | |
| 7,270,385 | B2 | 9/2007 | Mathur et al. | |
| 7,311,211 | B2 | 12/2007 | Chung | |
| 7,438,002 | B2 | 10/2008 | Murray | |
| 7,497,344 | B2 * | 3/2009 | Chen | A47B 96/028 248/220.42 |
| 8,479,664 | B2 | 7/2013 | Nelson | |
| 8,919,264 | B1 | 12/2014 | Lager | |
| 8,998,008 | B1 | 4/2015 | Robertson | |
| 9,131,771 | B2 | 9/2015 | Lindblom | |
| 9,173,506 | B2 | 11/2015 | Andersson et al. | |
| 9,277,818 | B1 | 3/2016 | Preston et al. | |
| 9,420,878 | B2 | 8/2016 | Lager | |
| 10,477,960 | B1 | 11/2019 | Johnson | |
| 10,487,499 | B1 | 11/2019 | Berkowitz | |
| 10,495,376 | B2 | 12/2019 | Roesch et al. | |
| 11,193,273 | B2 | 12/2021 | Berkowitz | |
| 11,619,043 | B2 | 4/2023 | Berkowitz | |
| 11,717,085 | B2 | 8/2023 | Nilsson et al. | |
| 12,049,756 | B2 | 7/2024 | Berkowitz | |
| 2003/0154673 | A1 | 8/2003 | MacGregor et al. | |
| 2004/0112258 | A1 | 6/2004 | Fichman | |
| 2008/0224004 | A1 | 9/2008 | Gallien | |
| 2013/0320829 | A1 | 12/2013 | Dries | |
| 2014/0197119 | A1 | 7/2014 | Stenhouse | |
| 2015/0216366 | A1 | 8/2015 | Knoll | |
| 2015/0292794 | A1 | 10/2015 | Bienick | |
| 2016/0007753 | A1 | 1/2016 | Mcmillin et al. | |
| 2016/0095437 | A1 | 4/2016 | Crandall | |
| 2018/0206641 | A1 | 7/2018 | Stefenack | |
| 2021/0131117 | A1 | 5/2021 | Warner | |

FOREIGN PATENT DOCUMENTS

| | | | |
|---|---|---|---|
| CN | 112869363 | B | 5/2022 |
| CN | 111887580 | B | 7/2022 |
| GB | 2135867 | B | 10/1986 |
| GB | 2346548 | A | 8/2000 |
| GB | 2372196 | A | 8/2002 |
| KR | 101908714 | B1 | 10/2018 |
| WO | WO97/19617 | | 6/1997 |

* cited by examiner

APPARATUS AND METHOD FOR RELEASABLY LOCKED FURNITURE

CROSS-REFERENCE TO RELATED APPLICATIONS

This Continuation-in-Part application claims the benefit under 35 U.S.C. § 120 of application Ser. No. 18/830,134 filed on Sep. 10, 2024 entitled APPARATUS AND METHOD FOR A RELEASABLY LOCKED DESKTOP IN A MODULAR CUBICLE and whose entire disclosure is incorporated by reference herein.

BACKGROUND OF THE INVENTION

The present invention relates generally to modular furniture and, more particularly, to an apparatus and method for a releasably securable desktop for coupling within the cubicle.

The use of cantilever brackets for assembling shelves in homes and businesses is well-known. An example of such "brackets and standards" style shelf is shown by the Dual Trak™ Shelf System sold by Knape & Vogt. However, these "brackets and standards" styles are designed for use on walls, not in cubicles.

FIGS. 1A-1B depict a modular business cubicle (MBC) that can be assembled from a plurality of tiles without the need for separate connectors for coupling the tiles together. See U.S. Pat. Nos. 10,487,499; 11,193,273; 11,619,043; and 12,049,756. In particular, the cubicle MBC comprises a plurality of tiles, T, that can be coupled together to form a first tier or level L1 of tiles, upon which a second tier or level L2 of tiles can be releasably secured and upon which a third tier or level L3 of tiles can be releasably secured.

Providing an associated desktop within the assembled cubicle is an important aspect to completing the modular business cubicle. Although there are removable desktops available for connecting within business cubicles, many of these desktops are connected to support brackets using fasteners, e.g., screws or nails. These fasteners can provide significant hazards since the screw or nails (e.g., 1.5") used may be longer than the thickness of the desktops (e.g., 1.25") and thus may pierce the desktop exposing the user to impalement.

Thus, there remains a need to provide for a removable desktop that can be safely, reliably and easily connected within the cubicle for use by workers. Thus, the subject invention addresses that need.

All references cited herein are incorporated herein by reference in their entireties.

BRIEF SUMMARY OF THE INVENTION

A releasable locking apparatus for releasably locking two components of furniture (e.g., conference tables, desks, desking systems (i.e., where multiple desks attach together with dividers to create a shared workspace), workbenches, coffee tables, end tables, café tables (e.g., lunch tables), training tables, reception desks, etc.) together is disclosed. The apparatus comprises: a plurality of projections located on an edge of a first component, wherein the plurality of projections are serially-aligned, and wherein the edge also comprises a cavity therein; a receptacle bracket comprising a plurality of serially-aligned chambers corresponding to the plurality of projections, wherein the receptacle bracket is secured within a surface of a second component; a release device positioned in an additional chamber, separate from the plurality of chambers, in the receptacle bracket, wherein the release device comprises a release button that is biased away from the additional chamber; and wherein the plurality of serially-aligned chambers are configured to receive the plurality of projections therein and allowing the plurality of projections to slide within their respective chambers when the first and second components are slid with respect to each other, thereby compressing the release button against the edge and halting the sliding when the release button seats within the cavity to releasably lock the first and second components together.

A furniture piece (e.g., conference tables, desks, desking systems (i.e., where multiple desks attach together with dividers to create a shared workspace), workbenches, coffee tables, end tables, café tables (e.g., lunch tables), training tables, reception desks, etc.) formed by components that are releasably secured together is disclosed. The furniture piece comprises: a first component having a receptacle bracket provided along an edge thereof, and wherein the receptacle bracket comprises a plurality of chambers; a second component having a plurality of projections along an edge thereof, wherein the plurality of projections corresponds to the plurality of chambers in the receptacle bracket; and a release device positioned within the receptacle bracket and comprising a release button that is biased away from said receptacle bracket, wherein the release button is configured to ride along the edge having the plurality of projections thereon when the plurality of projections is inserted into the corresponding plurality of chambers and the second component is moved in a first direction such that the projections are moved further within their respective chambers, and wherein the movement is halted when the release button seats within a cavity formed into the edge having the plurality of projections thereon, thereby releasably locking the first and second components together.

A method for releasably assembling a furniture piece (e.g., conference tables, desks, desking systems (i.e., where multiple desks attach together with dividers to create a shared workspace), workbenches, coffee tables, end tables, café tables (e.g., lunch tables), training tables, reception desks, etc.) having at least two components is disclosed. The method comprises: forming a receptacle bracket along an edge of a first component, wherein the receptacle bracket comprises a plurality of chambers and includes a release device having a release button that can be displaced and is biased away from the receptacle bracket; forming a plurality of projections, corresponding to the plurality of chambers, along an edge of a second component, wherein the edge of the second component also comprises a cavity configured for receiving the release button therein; inserting the plurality of projections into the plurality of chambers; and sliding the first component or the second component with respect to the other component so that the release button is compressed as it rides against the edge of the second component until it seats into the cavity, thereby releasably locking the first and second components together.

A method of releasably locking two components of furniture (e.g., conference tables, desks, desking systems (i.e., where multiple desks attach together with dividers to create a shared workspace), workbenches, coffee tables, end tables, café tables (e.g., lunch tables), training tables, reception desks, etc.) together is disclosed. The method comprises: providing a plurality of projections on an edge of a first component and which are serially-aligned and forming a cavity within the edge; embedding a receptacle bracket within a surface of a second component and wherein the bracket comprises a plurality of serially-aligned chambers corresponding to the plurality of projections; positioning a release device in an additional chamber, separate from the plurality of chambers, in the receptacle bracket and including a release button in the release device that is biased away from the additional chamber; inserting the plurality of projections within the corresponding plurality of chambers; and sliding the first component with respect to the second component causing the plurality of projections to slide within their respective chambers and thereby compressing the release button against the edge and halting the sliding when the release button seats within the cavity to releasably lock the first and second components together.

BRIEF DESCRIPTION OF SEVERAL VIEWS OF THE DRAWINGS

Many aspects of the present disclosure can be better understood with reference to the following drawings. The components in the drawings are not necessarily to scale, emphasis instead being placed upon clearly illustrating the principles of the present disclosure. Moreover, in the drawings, like reference numerals designate corresponding parts throughout the several views.

DETAILED DESCRIPTION OF THE PREFERRED EMBODIMENTS

Figure 1A:
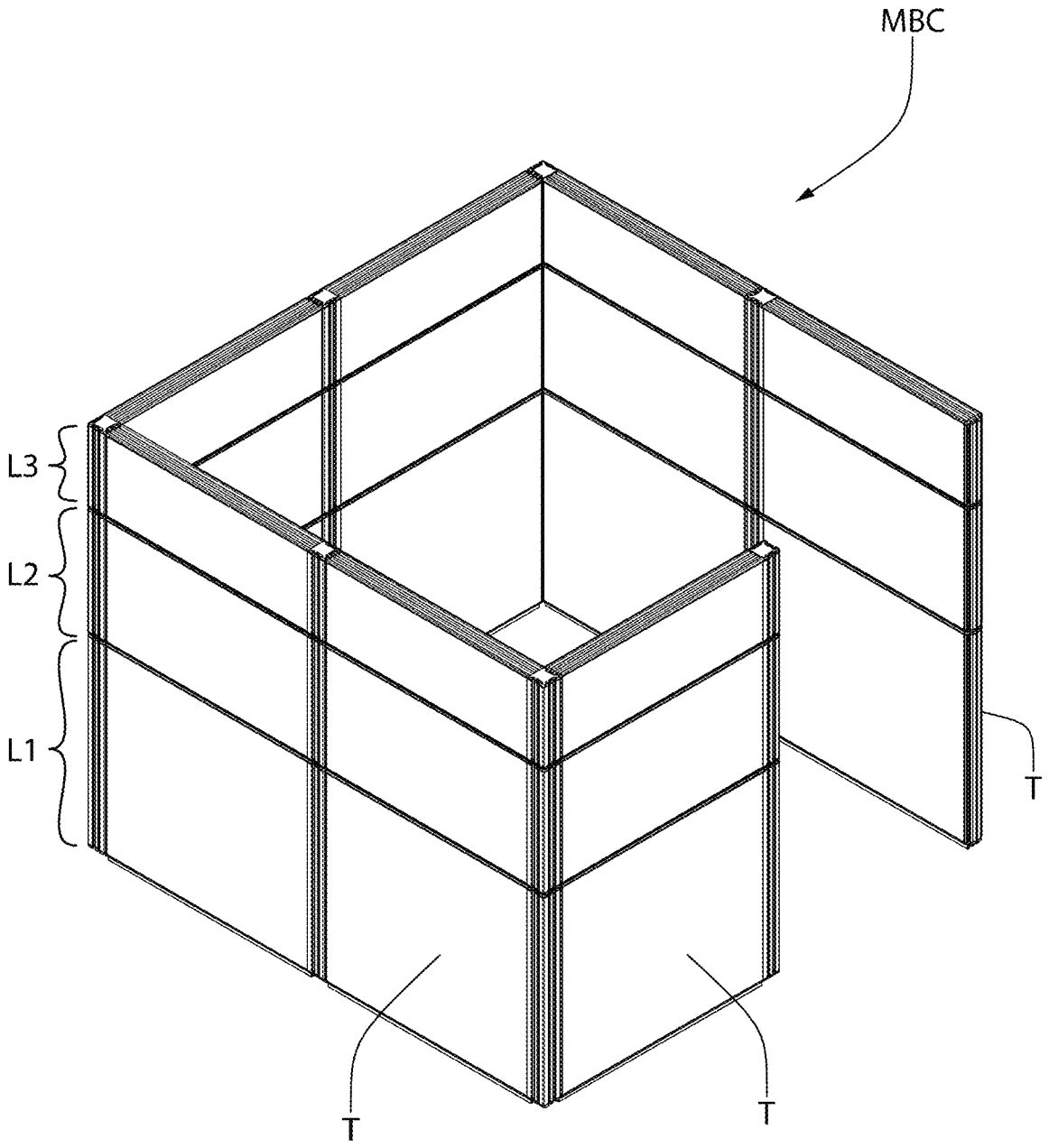
FIG. 1A (PRIOR ART)
FIG. 1A is an isometric view of a modular business cubicle formed by a plurality of tiles that do not require any separate connectors or tools.

Referring now to the figures, wherein like reference numerals represent like parts throughout the several views, exemplary embodiments of the present disclosure will be described in detail. Throughout this description, various components may be identified having specific values, these values are provided as exemplary embodiments and should not be limiting of various concepts of the present invention as many comparable sizes and/or values may be implemented.

Figure 1B:
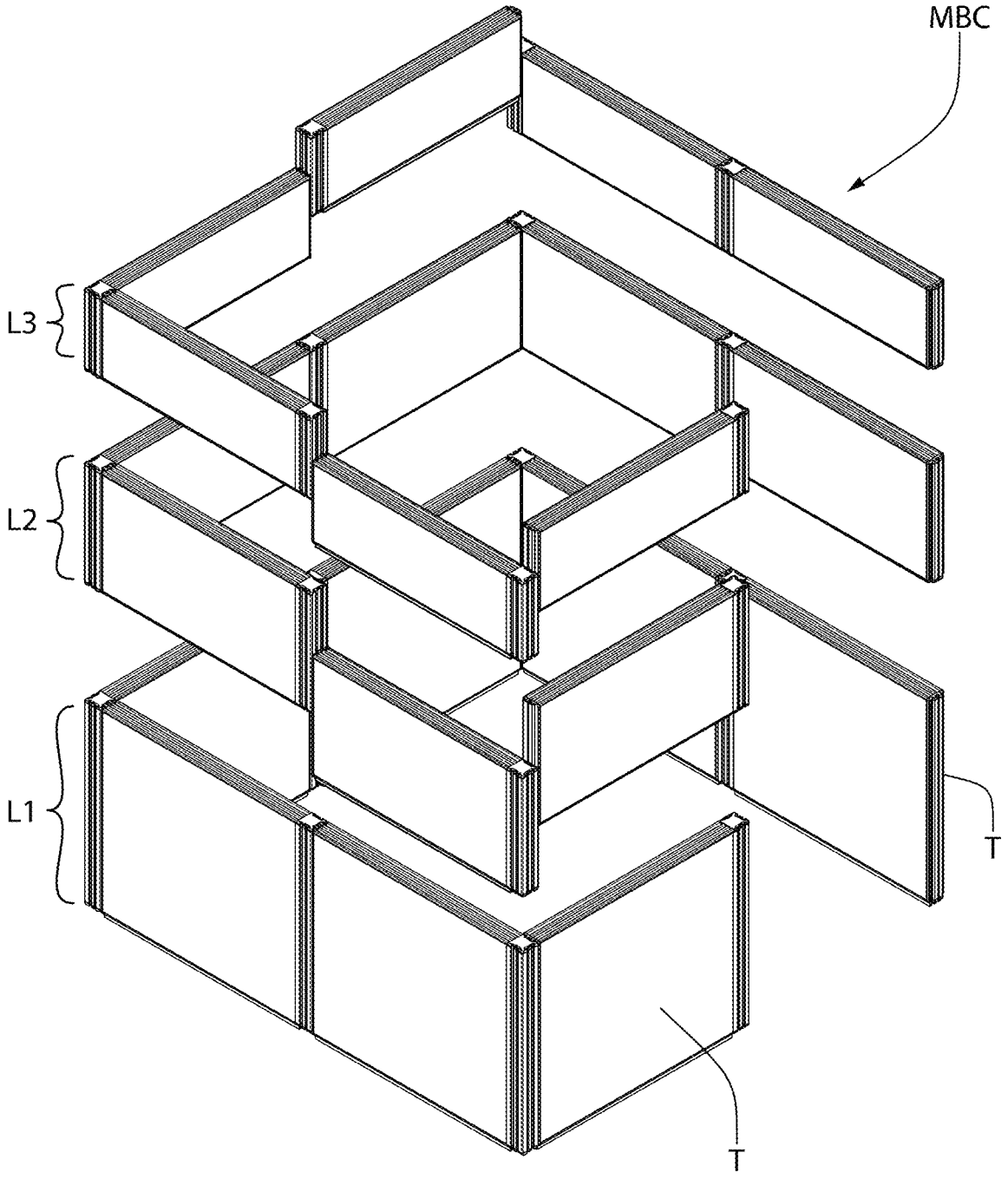
FIG. 1B (PRIOR ART)
FIG. 1B is an exploded view of the modular business cubicle of FIG. 1A showing the plurality of tiles with built-in tile connectors.
Figure 2:
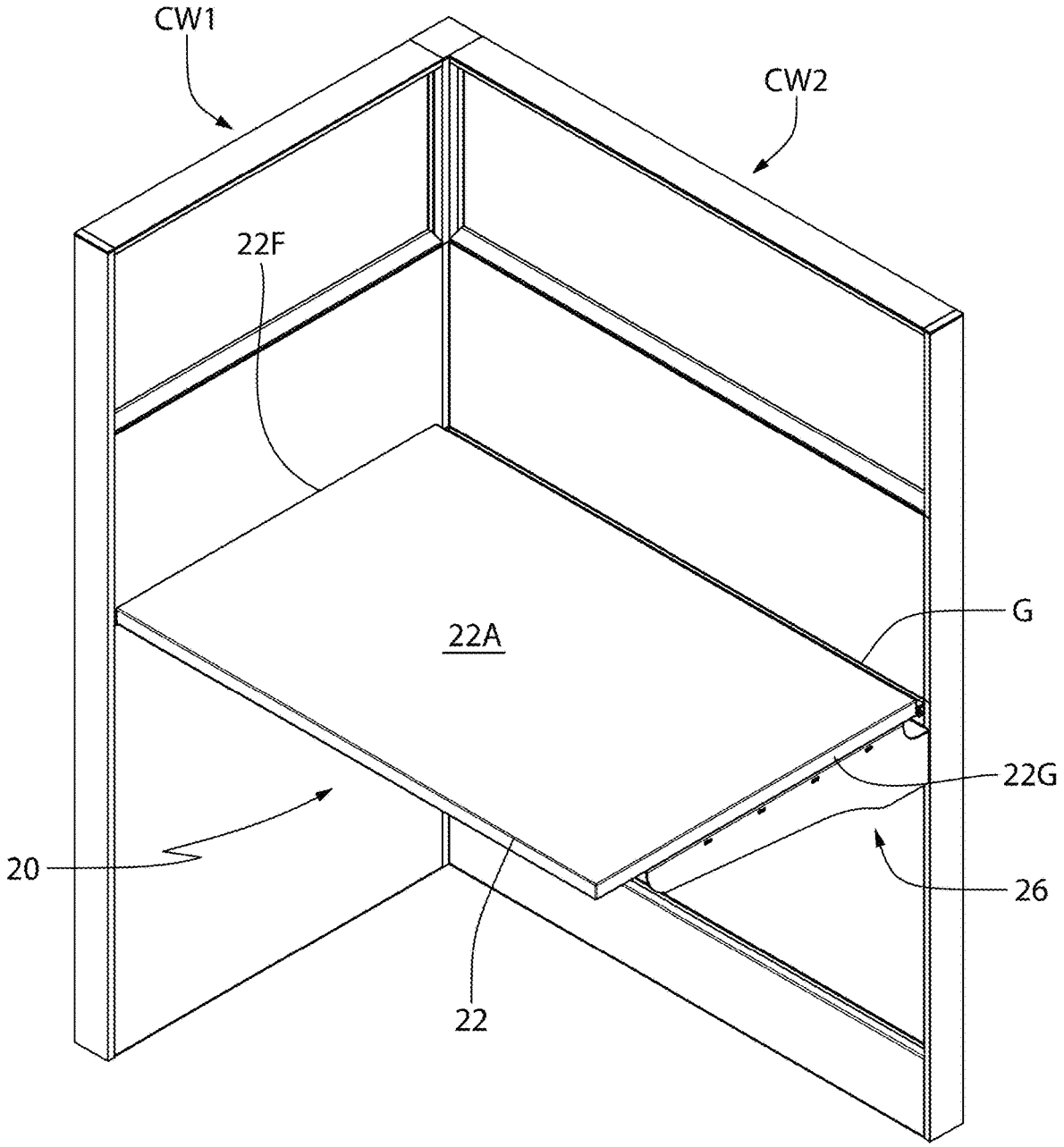
FIG. 2 is a top isometric view of an inside corner of the modular business cubicle showing the inventive releasable desktop apparatus with the desktop element positioned therein and locked in place.
Figure 25:
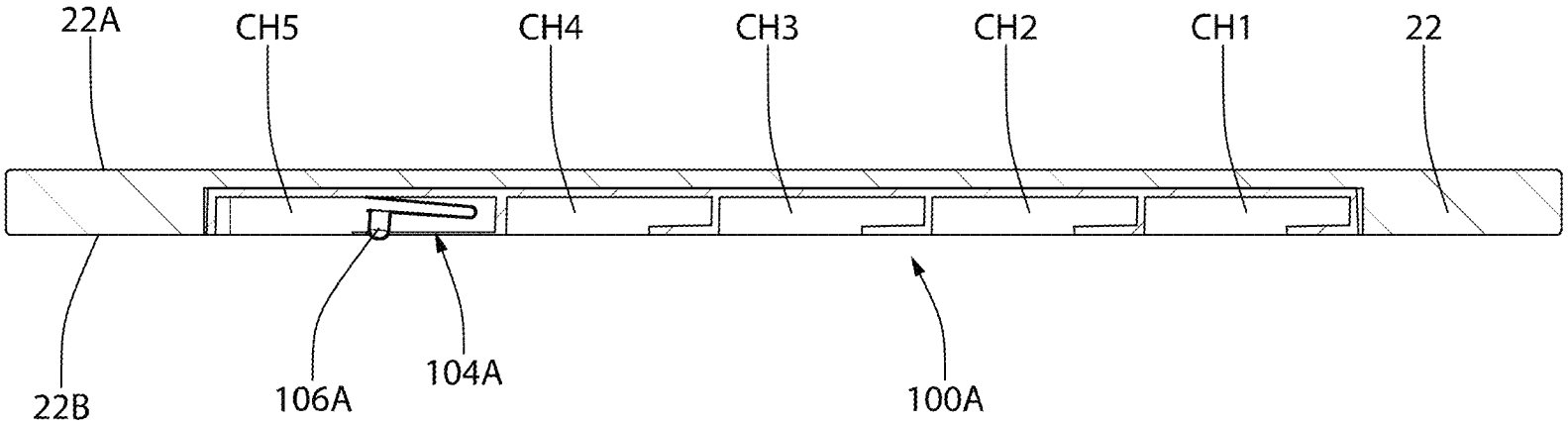
FIG. 25 is a cross-sectional view of the left receptacle bracket taken along line 25-25 of FIG. 24.
Figure 26:
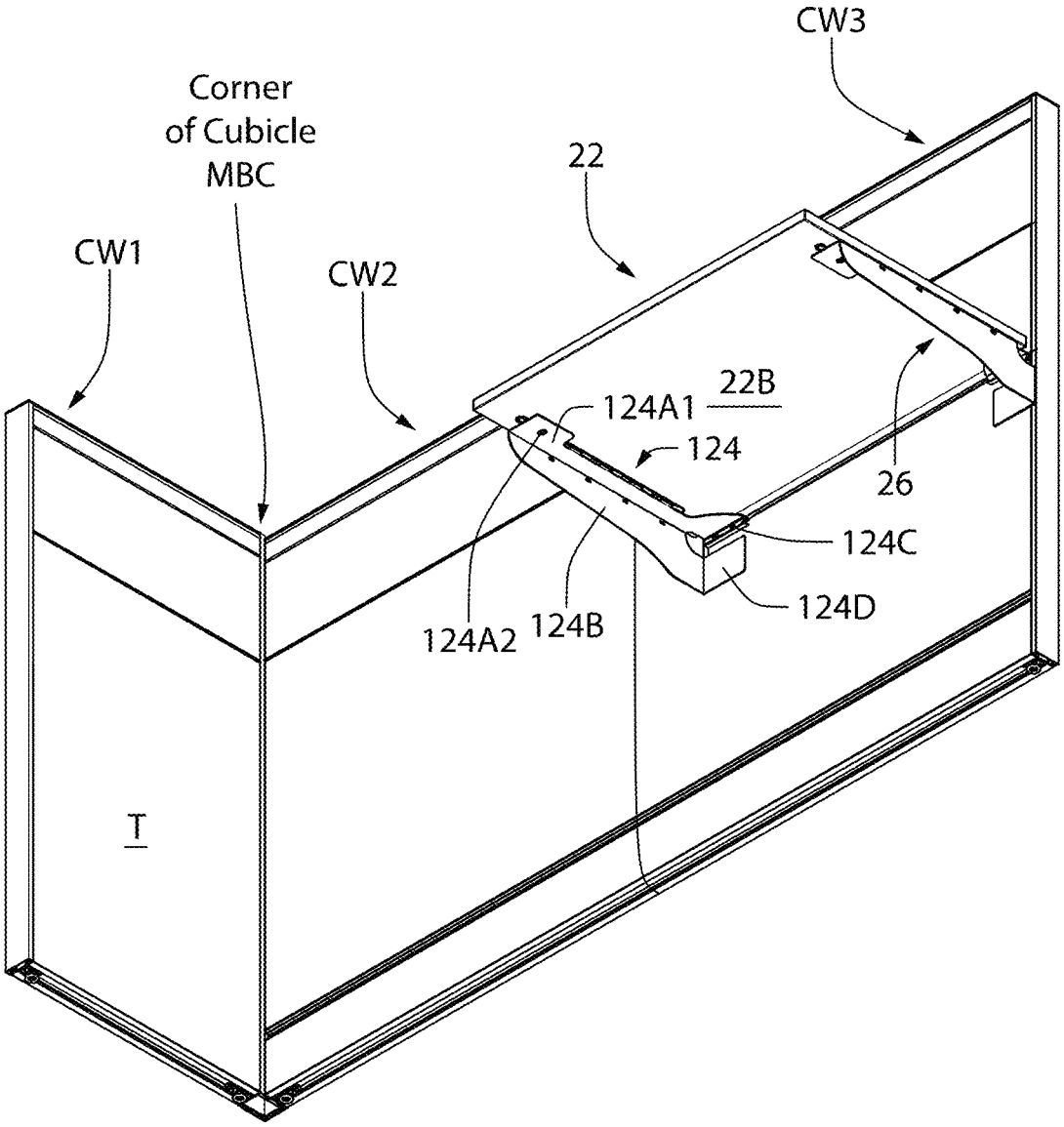
FIG. 26 is an isometric view of the desktop apparatus wherein the left-side and right-side support brackets comprise two cantilever brackets for mounting the desktop element on a cubicle wall not adjacent a cubicle corner.

FIG. 1 depicts the inventive desktop apparatus 20 positioned in a corner of a modular business cubicle (MBC) by way of example only; the apparatus 20 can be used with any type of cubicle having tiles or segments, as will be apparent from the detailed discussion below. FIG. 26 depicts the inventive desktop apparatus 20 positioned on a wall of the cubicle but not adjacent a corner of the cubicle MBC. Thus, FIGS. 2-25 discuss the desktop apparatus 20 being installed within the corner of the cubicle MBC. The desktop apparatus 20 being installed completely along a wall of the cubicle MBC, with the understanding that the left side supporting bracket 124 in FIG. 26 is a "mirror structure" of the right side support bracket 26 but the releasable locking mechanism works the same.

As mentioned above, FIG. 1 depicts the inventive desktop apparatus 20 positioned in the corner but with a desktop element 22 not yet locked in place. As can be seen most clearly in FIG. 3, the desktop apparatus 20 comprises the desktop element 22 having a left side 22F and a right side 22G. Both of these sides are positioned on support brackets 24 and 26 that are releasably coupled to cubicle walls CW1 and CW2, respectively. The left-side support bracket (LSSB) 24 is releasably coupled to cubicle wall CW1 and the right-side support bracket (RSSB) 26 is releasably coupled to cubicle wall CW2, the details of which are discussed later.

As shown most clearly in FIGS. 22-25, the desktop element 22 comprises a top side 22A and a bottom side 22B, a left side 22F and a right side 22G. As shown most clearly in FIGS. 23-24, receptacle brackets 100A and 100B are installed on opposite sides of the bottom side 22B. Liner grooves 22C and 22D are formed into the bottom surface 22B, along the respective sides 22F/22G of the desktop element 22. An adhesive 102A and 102B is applied inside the respective grooves 22C/22D. The receptacle brackets 100A/100B are then fixedly pressed and secured inside the grooves so that the receptable brackets 100A/100B form a smooth contour with the bottom surface 22B. Each receptacle bracket 100A/100B comprises a plurality (e.g., five) serially-aligned chambers, CH1, CH2, CH3, CH4 and CH5. Chambers CH1-CH4 are configured to receive respective L-shaped projections P1, P2, P3 and P4 of the brackets 24/26, as shown most clearly in FIG. 20. Chamber CH5 in each receptacle bracket 100A/100B contains a respective release device 104A and 104B, as discussed next.

Figure 21:
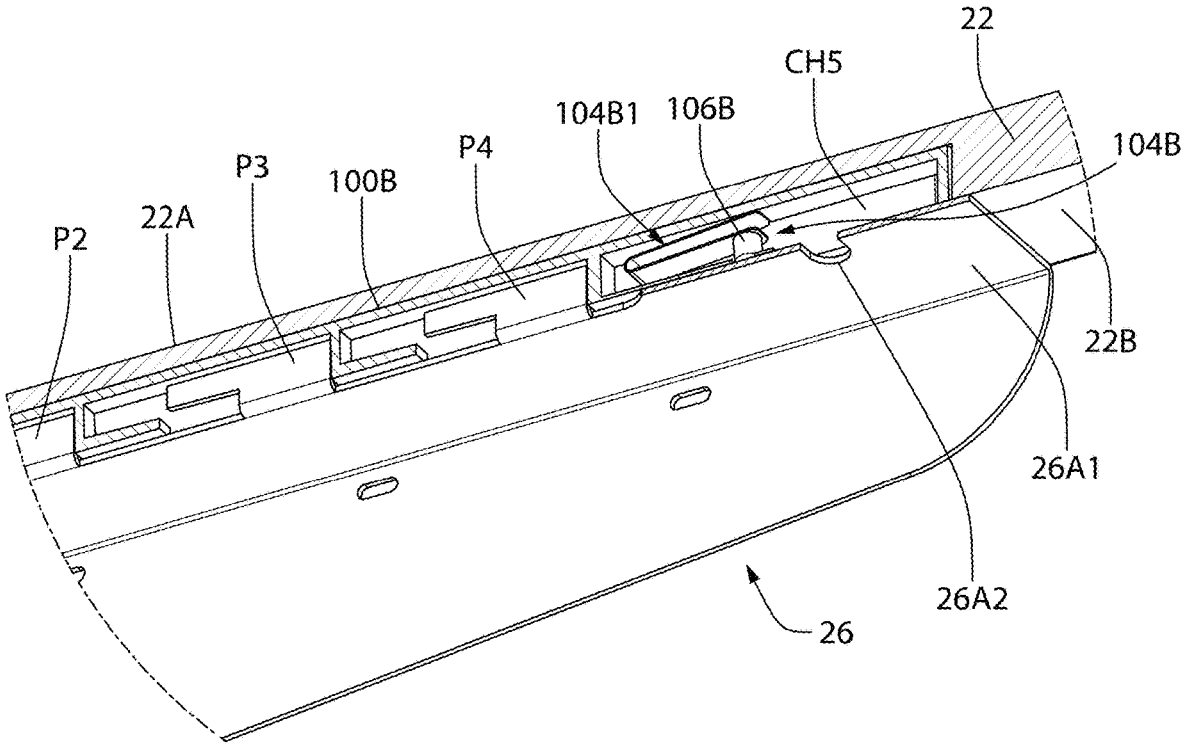
FIG. 21 is a partial cross-sectional isometric view of the right-side support bracket coupled to the right receptacle bracket but not yet locked in place.
Figure 22:
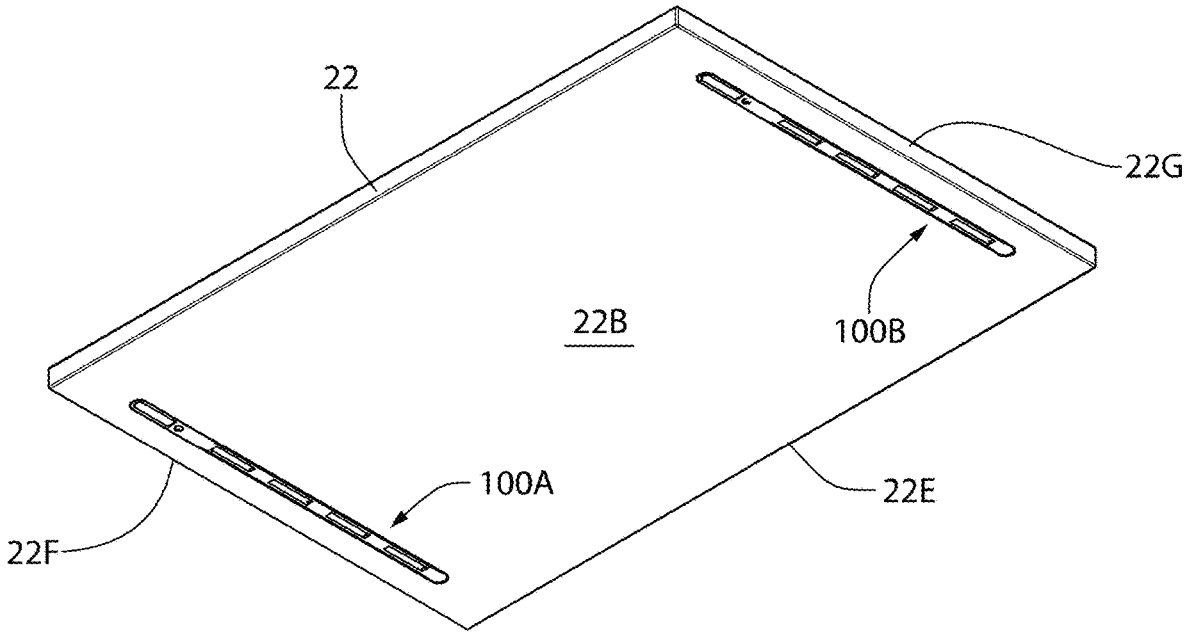
FIG. 22 is an isometric view of the desktop element showing the bottom side.
Figure 23:
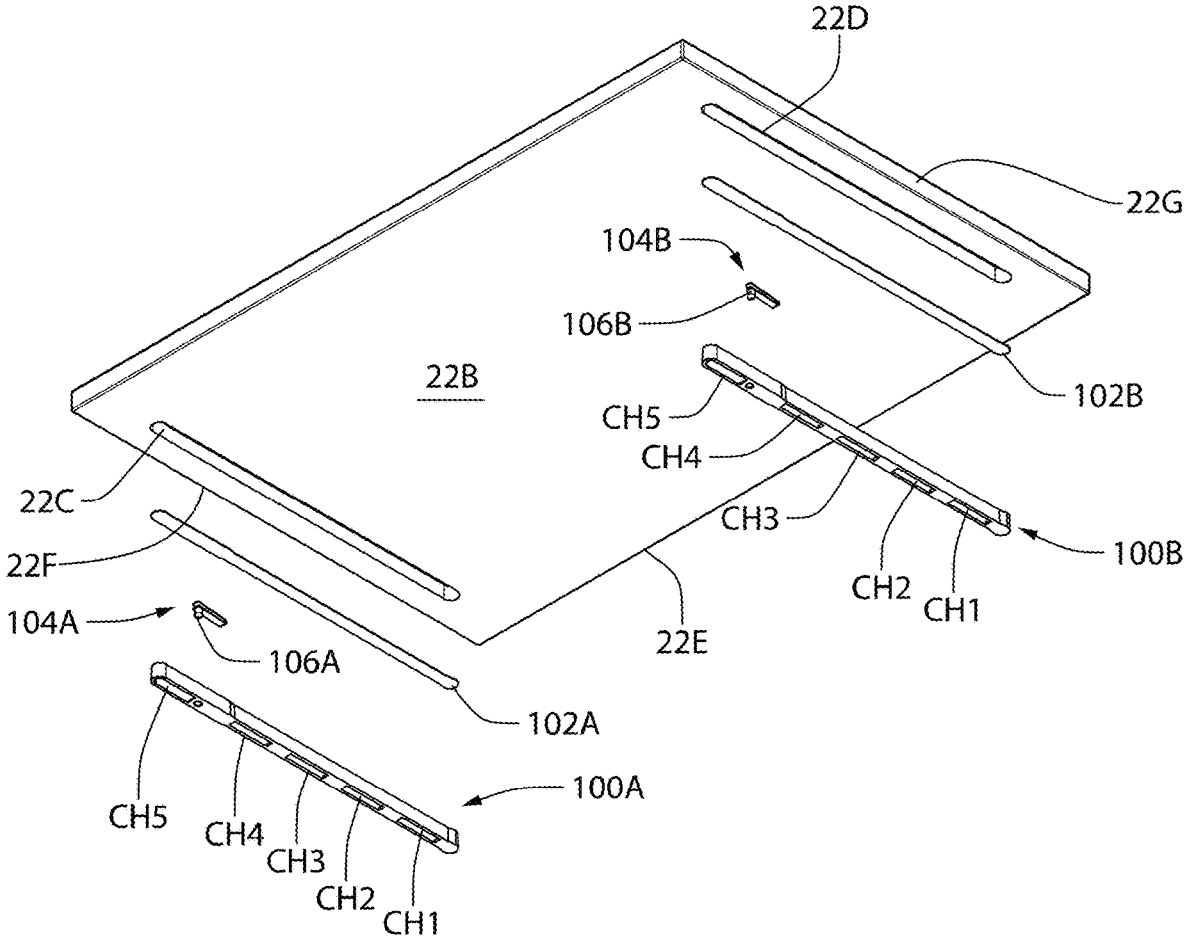
FIG. 23 is similar to FIG. 22 but showing the left and right receptacle brackets in an exploded view.
Figure 24:
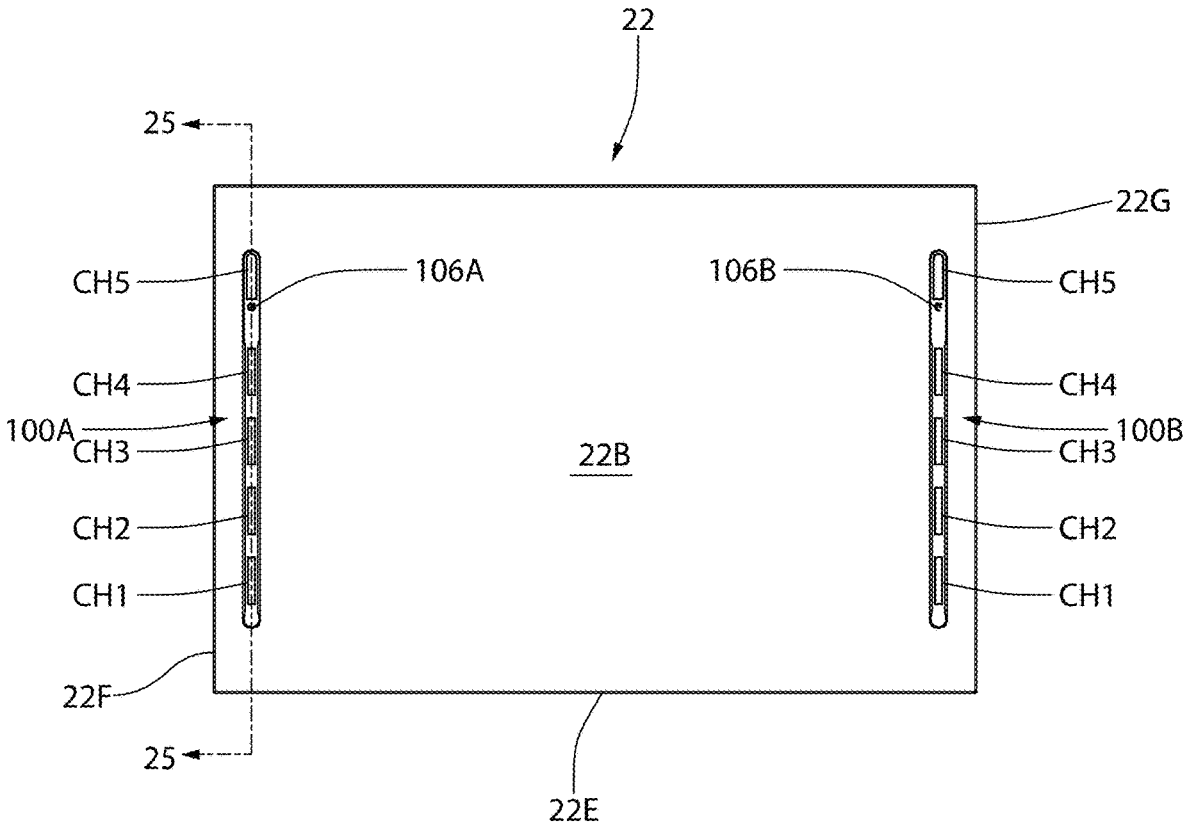
FIG. 24 is a plan view of the bottom side of the desktop element.

Each release device 104A/104B comprises a small leaf spring in a "V-shape" having a corresponding release button 106A/106B on one end of the leaf spring. FIG. 21 depicts release device 104B positioned in chamber CH 5 of receptacle bracket 100B (it being understood that the same goes for the release device 104A in chamber CH5 of the other receptacle bracket 100A). One portion of the "V-shaped" leaf spring 104B1 is secured to an upper wall of the fifth chamber CH5, while the other portion of the V-shaped leaf spring 104B1 having the release button 106B thereon is free to move up and down (similarly, the same goes for the release device 104A, shown in FIG. 25). FIG. 25 is cross-sectional view of the left receptacle bracket 100A, showing the five chambers CH1-CH5, along with the release device 104A secured inside chamber CH5.

The following discussion relates to the left-side support bracket (LSSB) 24 and the right-side support bracket (RSSB) 26.

Figure 3:
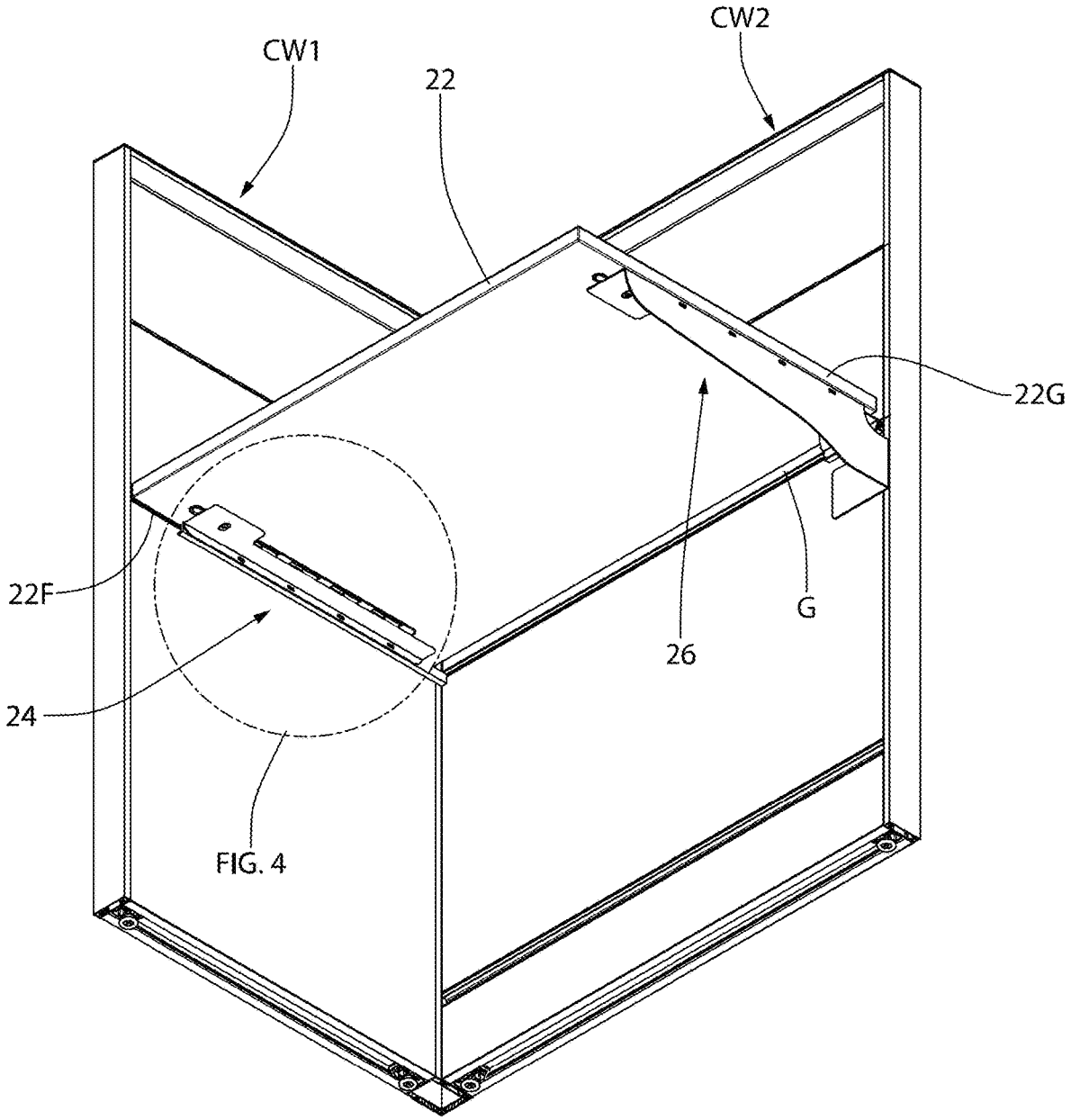
FIG. 3 is a bottom isometric view of an inside corner of the modular business cubicle showing the inventive releasable desktop apparatus of FIG. 2 with the desktop element positioned therein locked in place.
Figure 4:
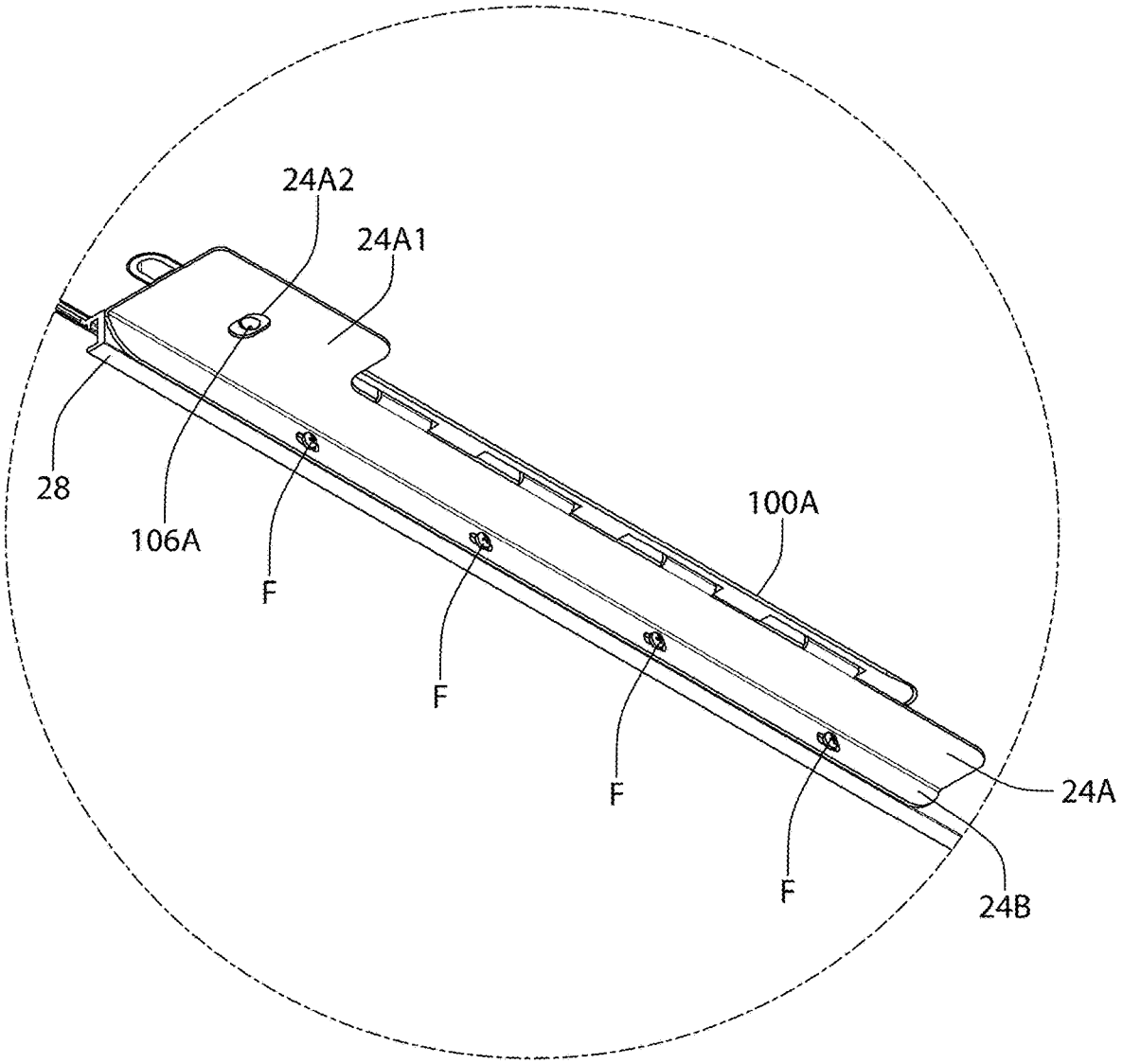
FIG. 4 is an enlarged isometric view of the left cantilever bracket installed on a cubicle wall.

As shown most clearly in FIGS. 3-4, the LSSB 24 comprises a horizontal flange 24A and a vertical flange 24B. The horizontal flange 24A comprises an extension 24A1 with an aperture 24A2. Vertical flange 24B comprises a plurality of apertures to receive fasteners (e.g., screws) therethrough for securing the LSSB 24 to the cubicle wall CW1. The top side of the horizontal flange 24A comprises a plurality (e.g., four) L-shaped projections P1-P4 (see FIG. 8) which are configured to fit into the corresponding chambers CH1-CH4 in receptacle bracket 100A.

With the left-side 22F of desktop element 22 is positioned over the LSSB 24 and the projections P1-P4 inserted into the respective chambers CH1-CH4, when the desktop element 22 is slid back (away from the wall CW2, towards the installer), the release button 106A slides over the extension 24A1. As the sliding motion continues, the release button 106A finally seats itself into the aperture 24A2, thereby releasably locking that side of the desktop element 22 into the LSSB 24.

Figure 5:
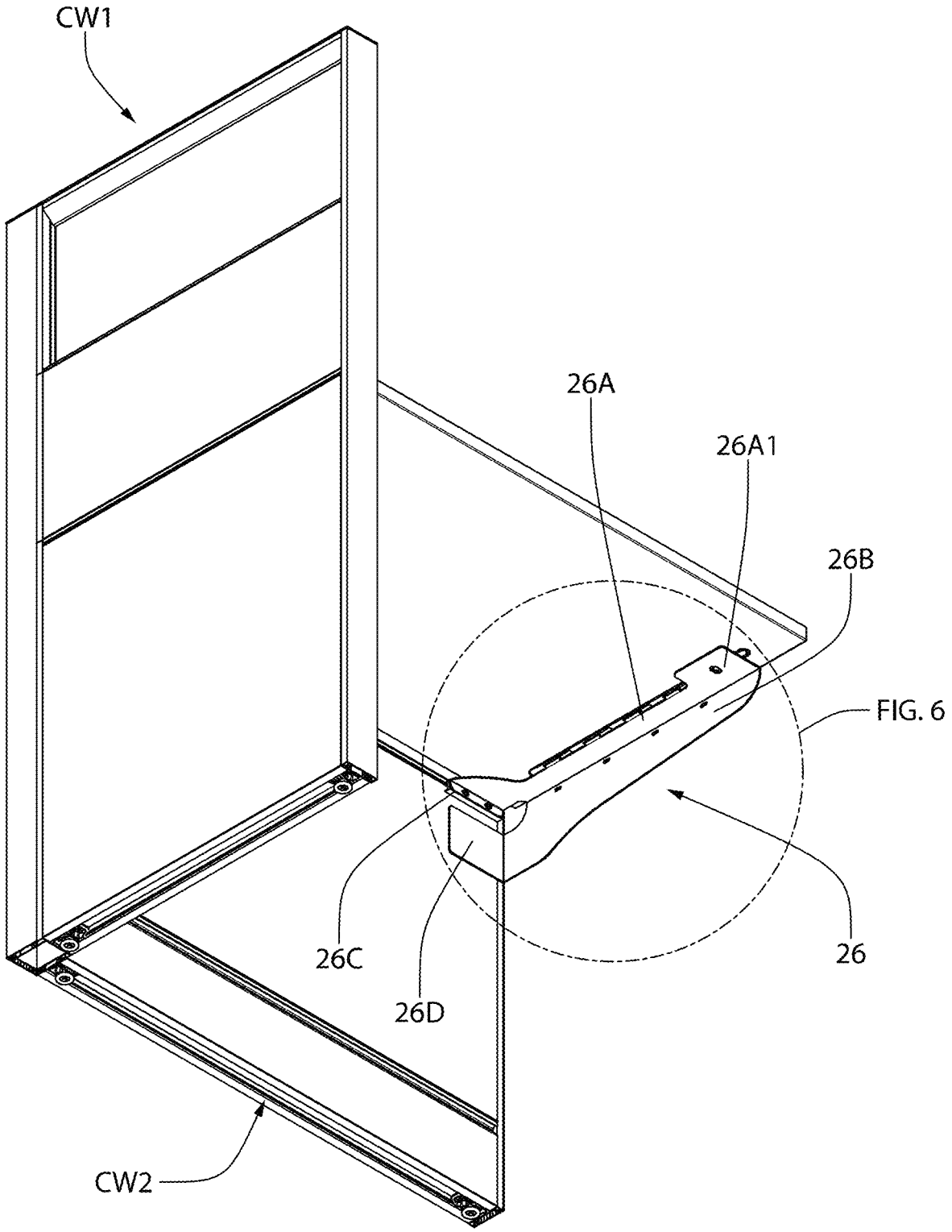
FIG. 5 is a bottom isometric view of the right underside of the inventive releasable desktop apparatus of FIG. 2 with the desktop element positioned therein and locked in place.
Figure 6:
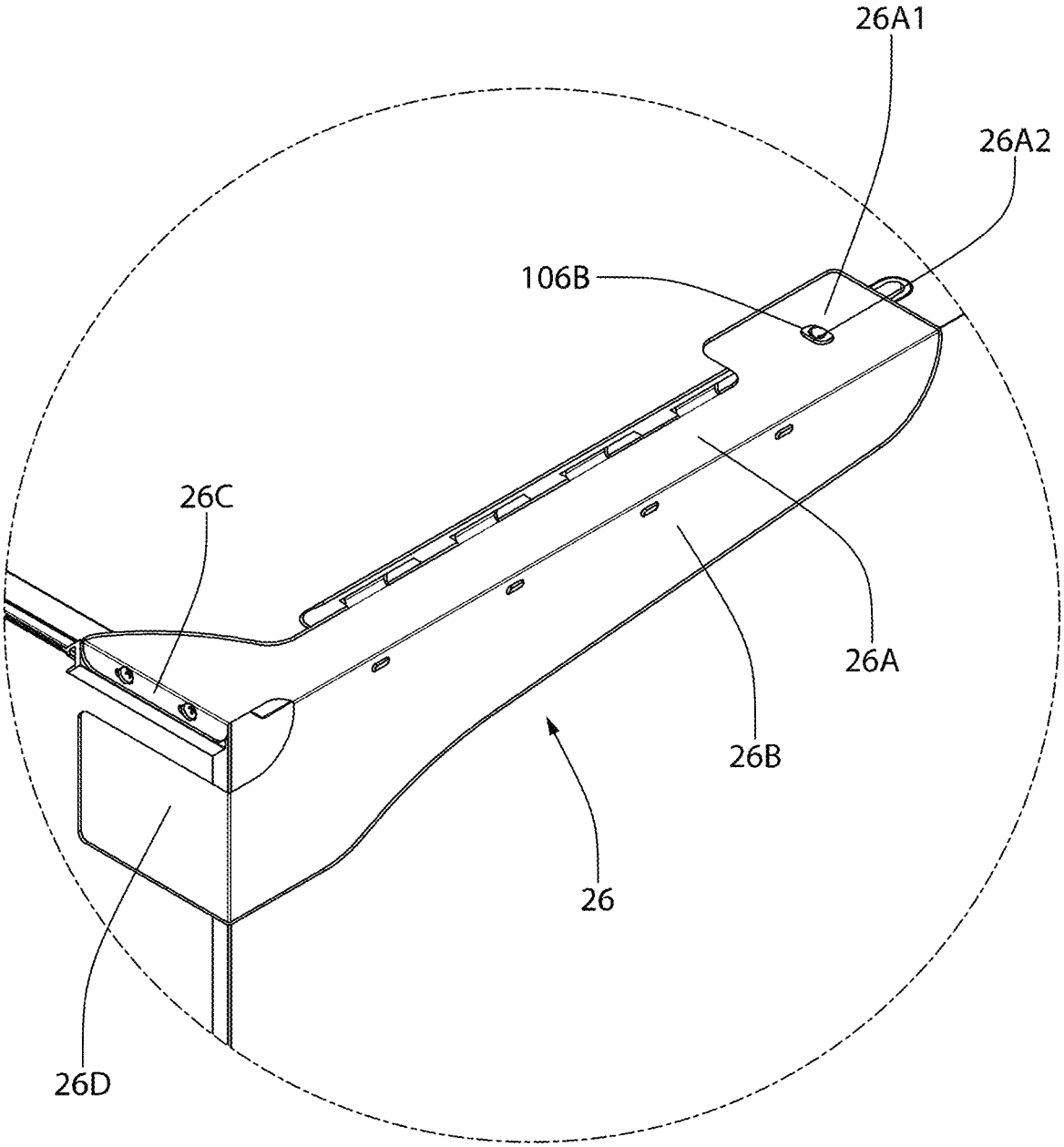
FIG. 6 is an enlarged isometric view of the right-side support bracket installed on another cubicle wall.

The details of the RSSB 26 are shown in FIGS. 5-6. The bracket 26 also comprises a horizontal flange 26A and a vertical flange 26B. In addition, since the RSSB 26 is positioned at the "open" right side 22G of the desktop element 22, the RSSB 24 forms a "cantilever" bracket in that the RSSB 24 is attached only at one end to the cubicle wall CW2. The releasable securement of the RSSB 26 to the cubicle wall CW2 is implemented via a perpendicular forward portion comprising an upper vertical flange 26C and a lower vertical flange 26D. Upper vertical flange 26C downwardly depends from the horizontal flange 26A whereas lower vertical flange 26D is a perpendicular extension of the vertical flange 26B. As with the LSSB 24, the horizontal flange 26A comprises an extension 26A1 with an aperture 26A2. When the right-side 22G of desktop element 22 is positioned over the RSSB 26 and the projections P1-P4 inserted into the respective chambers CH1-CH4, when the desktop element 22 is slid back (away from the wall CW2, towards the installer), the release button 106B slides over the extension 26A1. As the sliding motion continues, the release button 106B finally seats itself into the aperture 24A2, thereby releasably locking that side of the desktop element 22 into the RSSB 26.

The following discussion is related to releasably mounting the LSSB 24 and the RSSB 26 to respective cubicle walls CW1 and CW2 that form a corner (again, by way of example only) in the modular business cubicle MBC.

Figure 7:
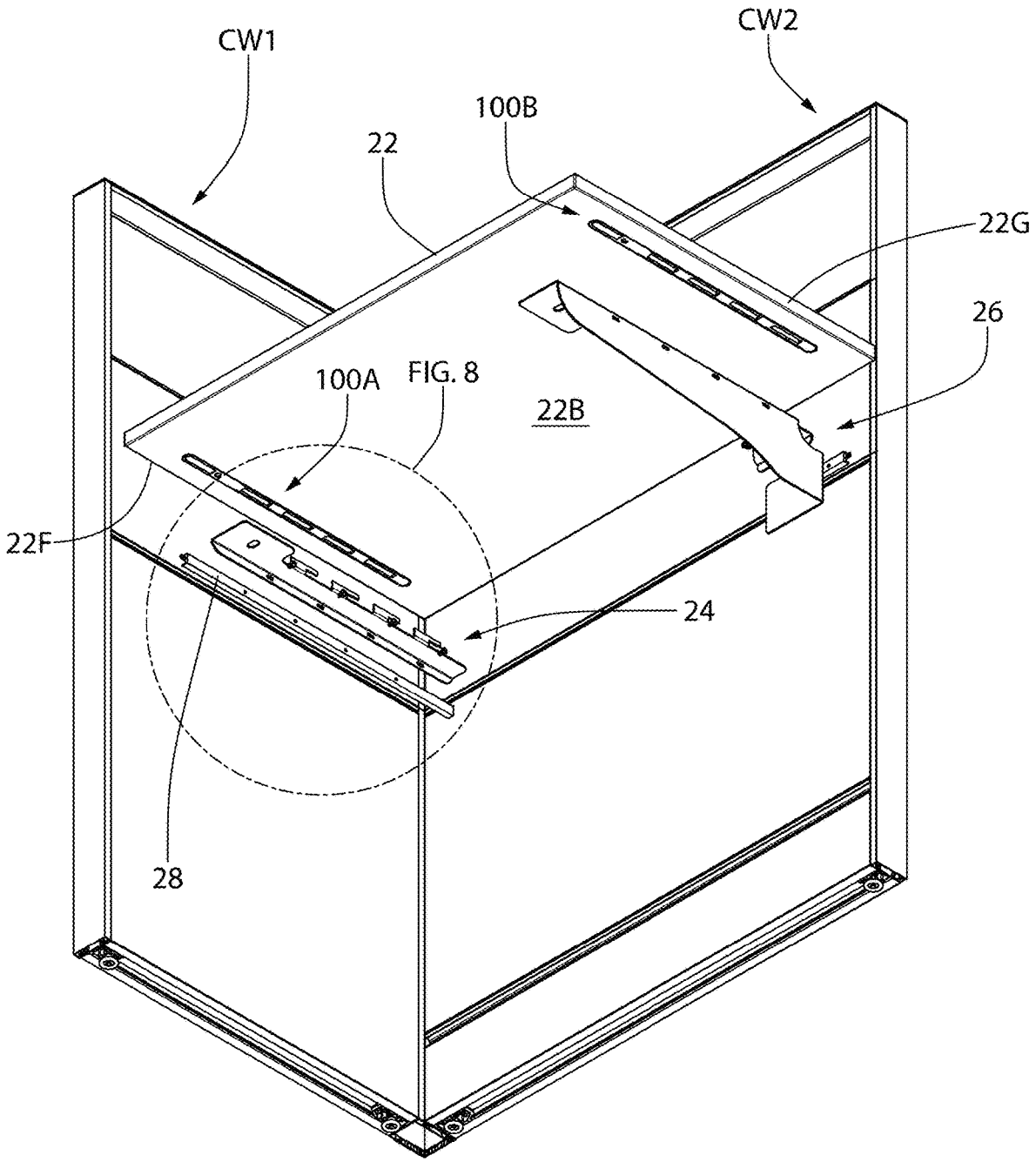
FIG. 7 is a bottom isometric view the invention with the left-side and right-side support brackets and their couplings to respective cubicle walls shown in an exploded view.
Figure 8:
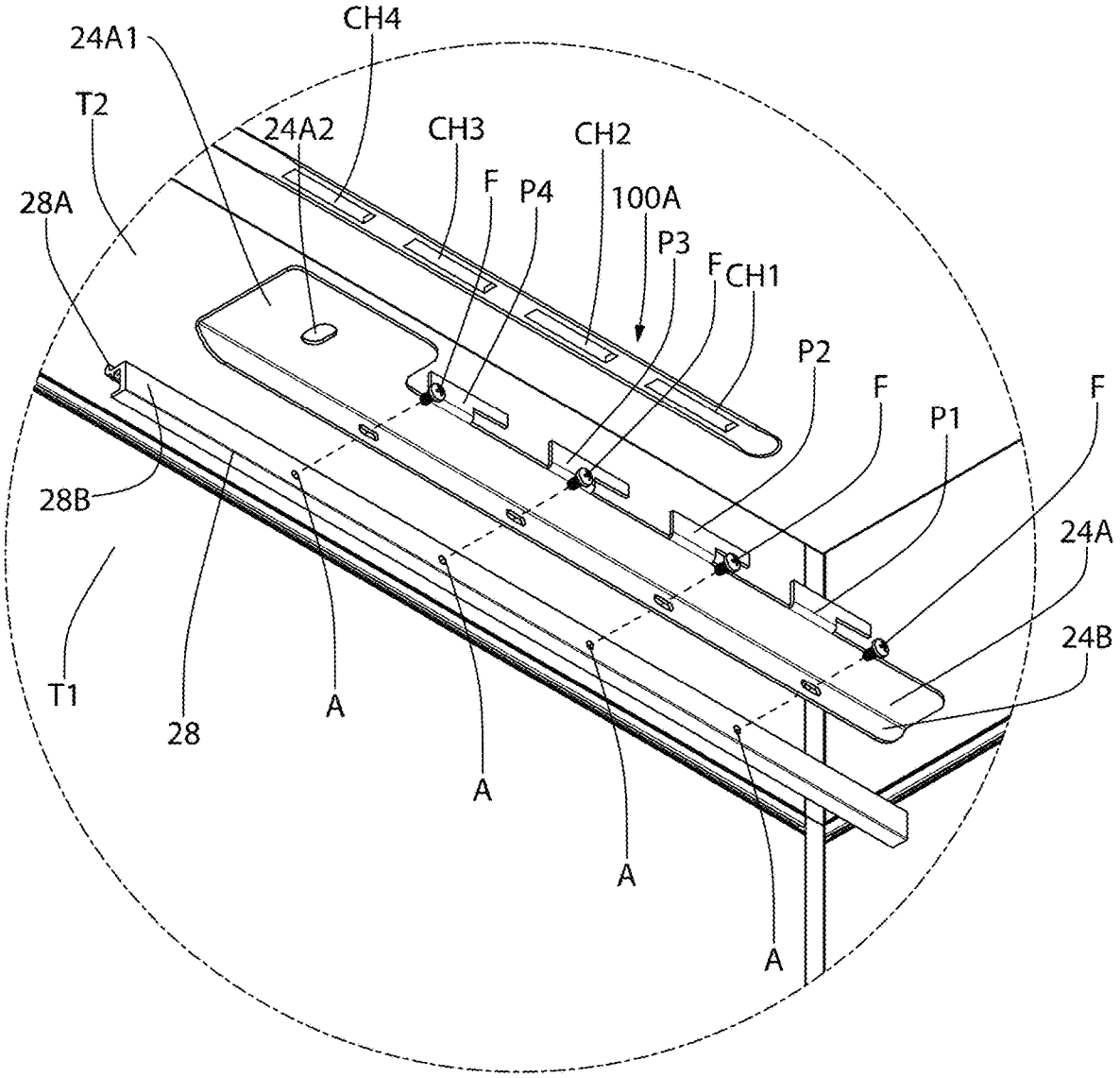
FIG. 8 is an enlarged exploded view of the left-side support bracket and its couplings to a cubicle wall.

As shown most clearly in FIG. 7, a C-shaped mounting bracket 28 is used to secure the LSSB 24. In particular, the C-shaped mounting bracket 28 has a lip 28A (FIG. 8) that is inserted in between two vertically-connected tiles T1/T2. With that lip 28A trapped between the two tiles T1/T2, the C-shaped mounting bracket 28 provides a "standoff surface" 28B for receiving fasteners F (e.g., screws) therethrough. As shown in FIG. 8, the standoff surface 28B comprises a plurality of apertures A. When the LSSB 24 is to be secured to the cubicle wall CW1, oval-shaped apertures OA in the vertical flange 24B are aligned with the bracket apertures A and the fasteners F secured therein. The oval-shaped apertures OA allow for horizontal adjustment of the LSSB 24.

Figure 9:
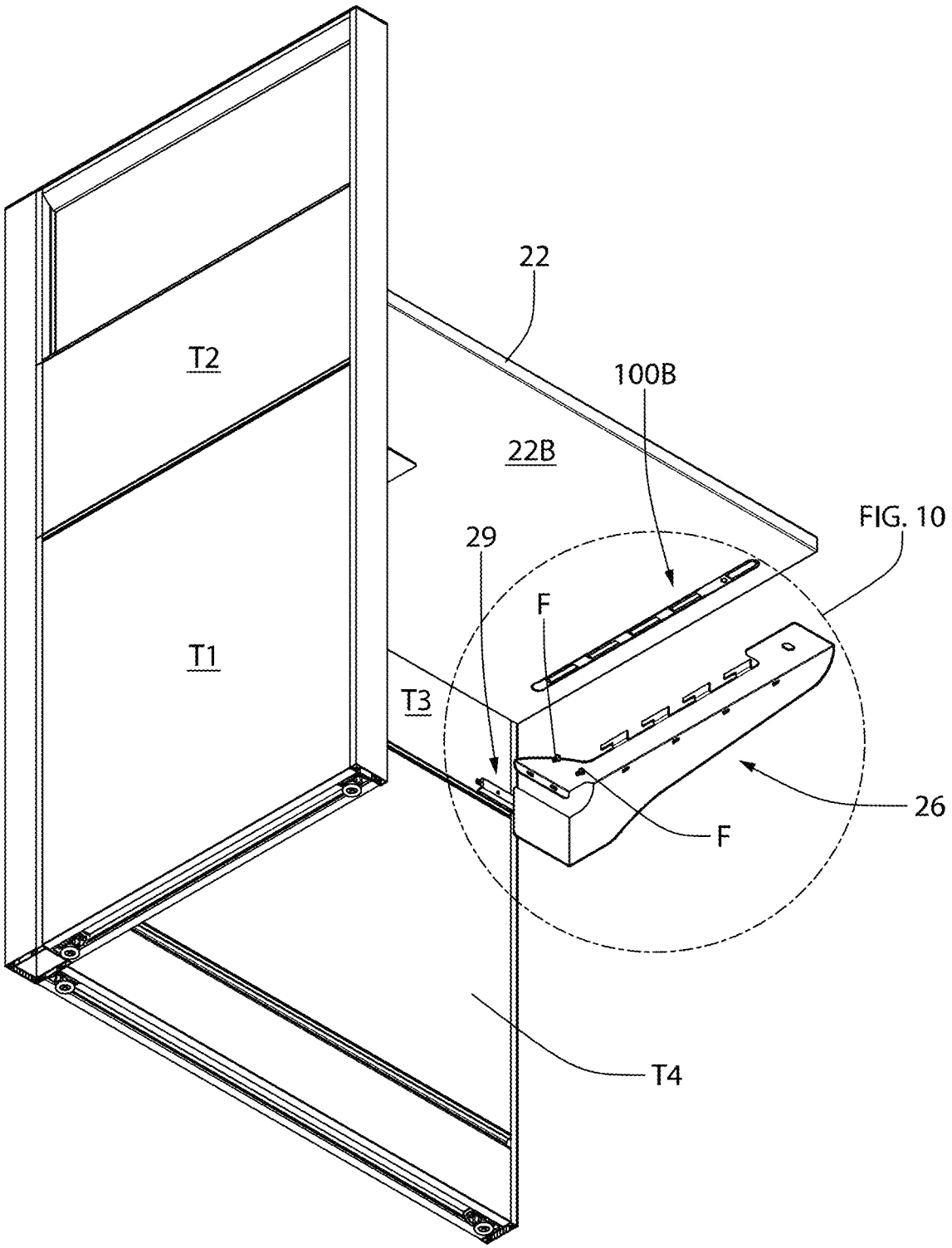
FIG. 9 is a bottom isometric view of the invention with the right-side support bracket and its couplings to a cubicle wall shown in an exploded view.
Figure 10:
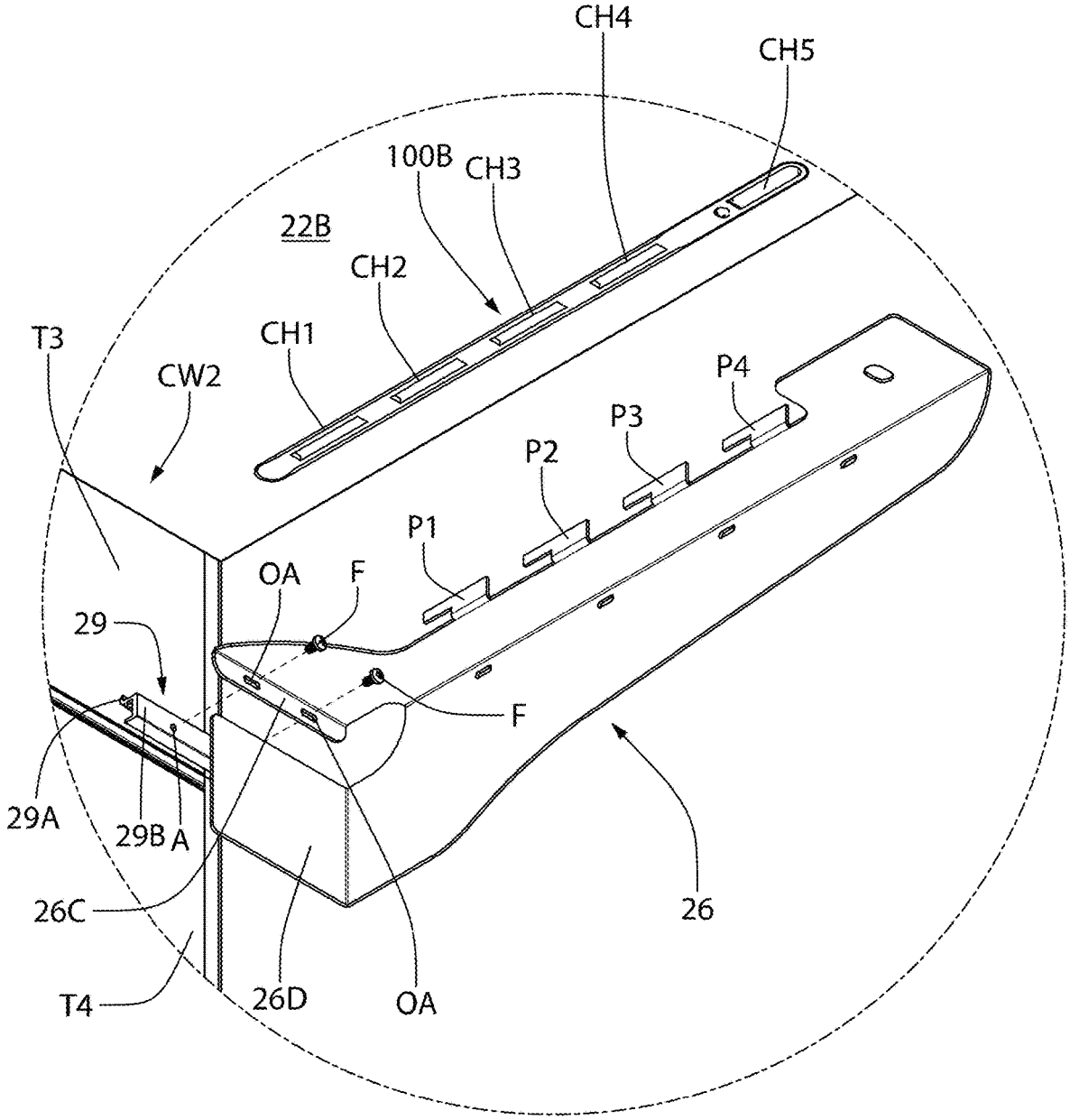
FIG. 10 is an enlarged exploded view of the right-side support bracket and its couplings to a cubicle wall.
Figure 11:
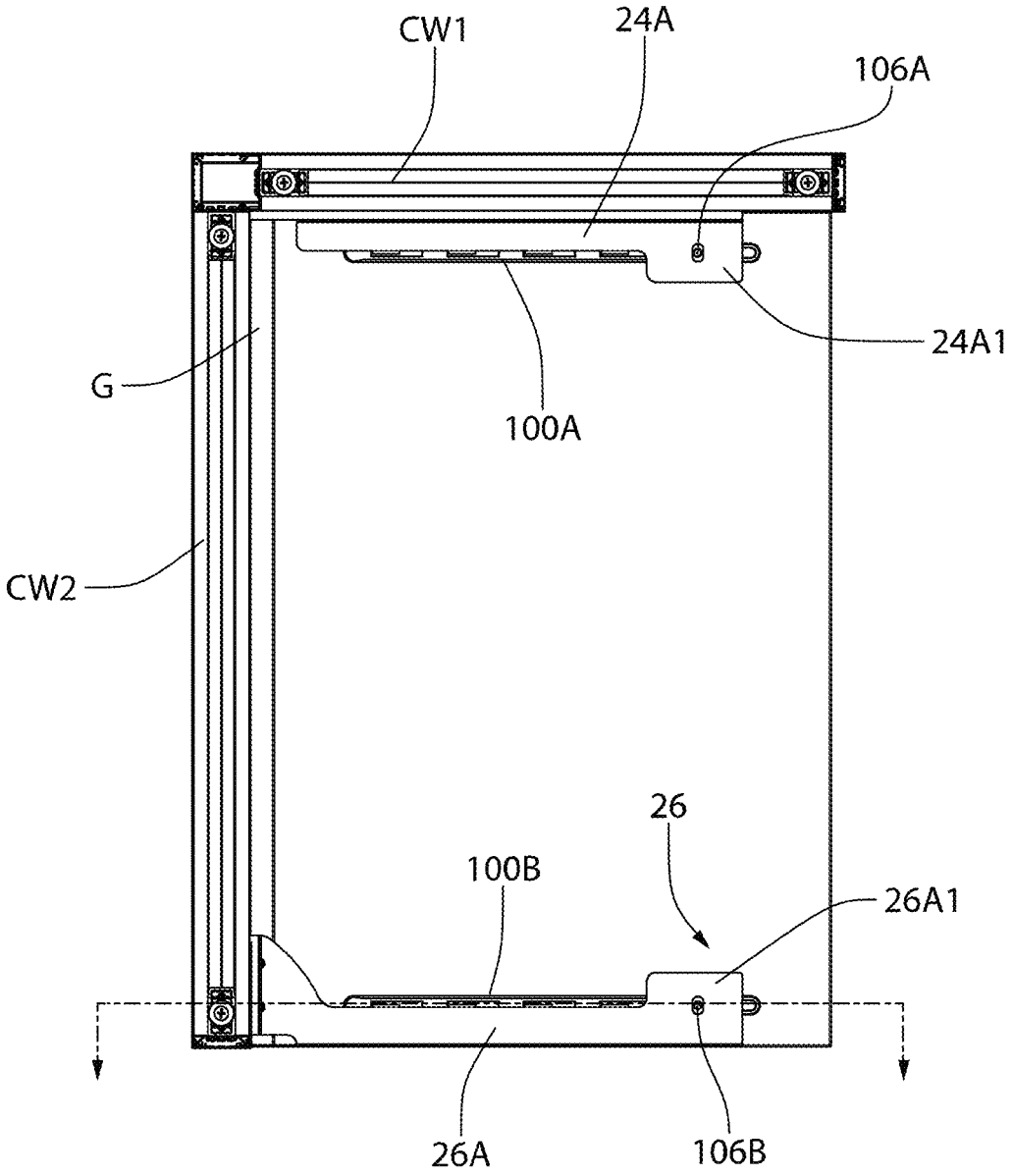
FIG. 11 is a bottom plan view of the inventive releasable desktop apparatus of FIG. 2 with the desktop element positioned therein and locked in place.
Figure 12:
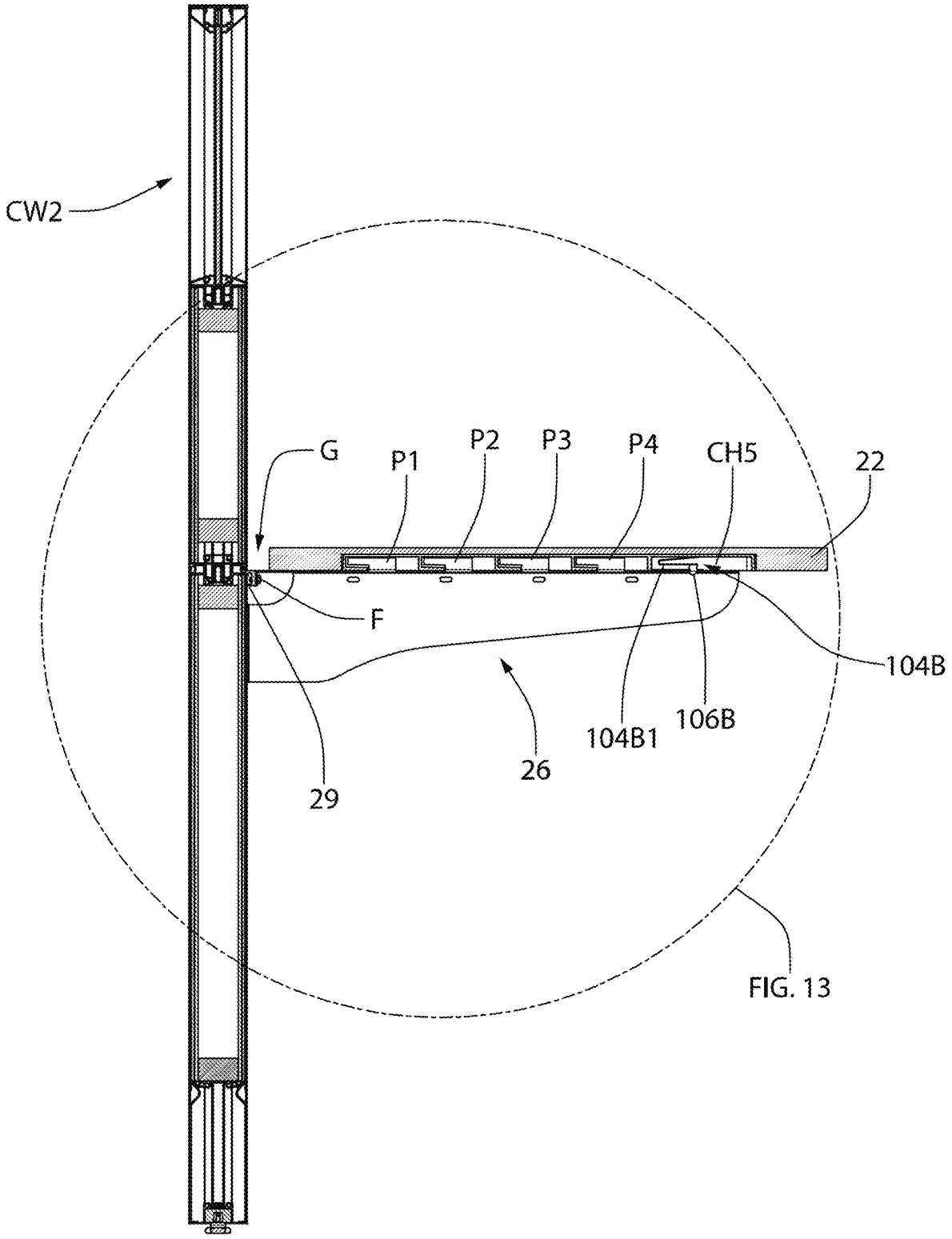
FIG. 12 is a cross-sectional view of the right-side support bracket locked into the right receptacle bracket of the desktop element taken along line 12-12 of FIG. 11.
Figure 13:
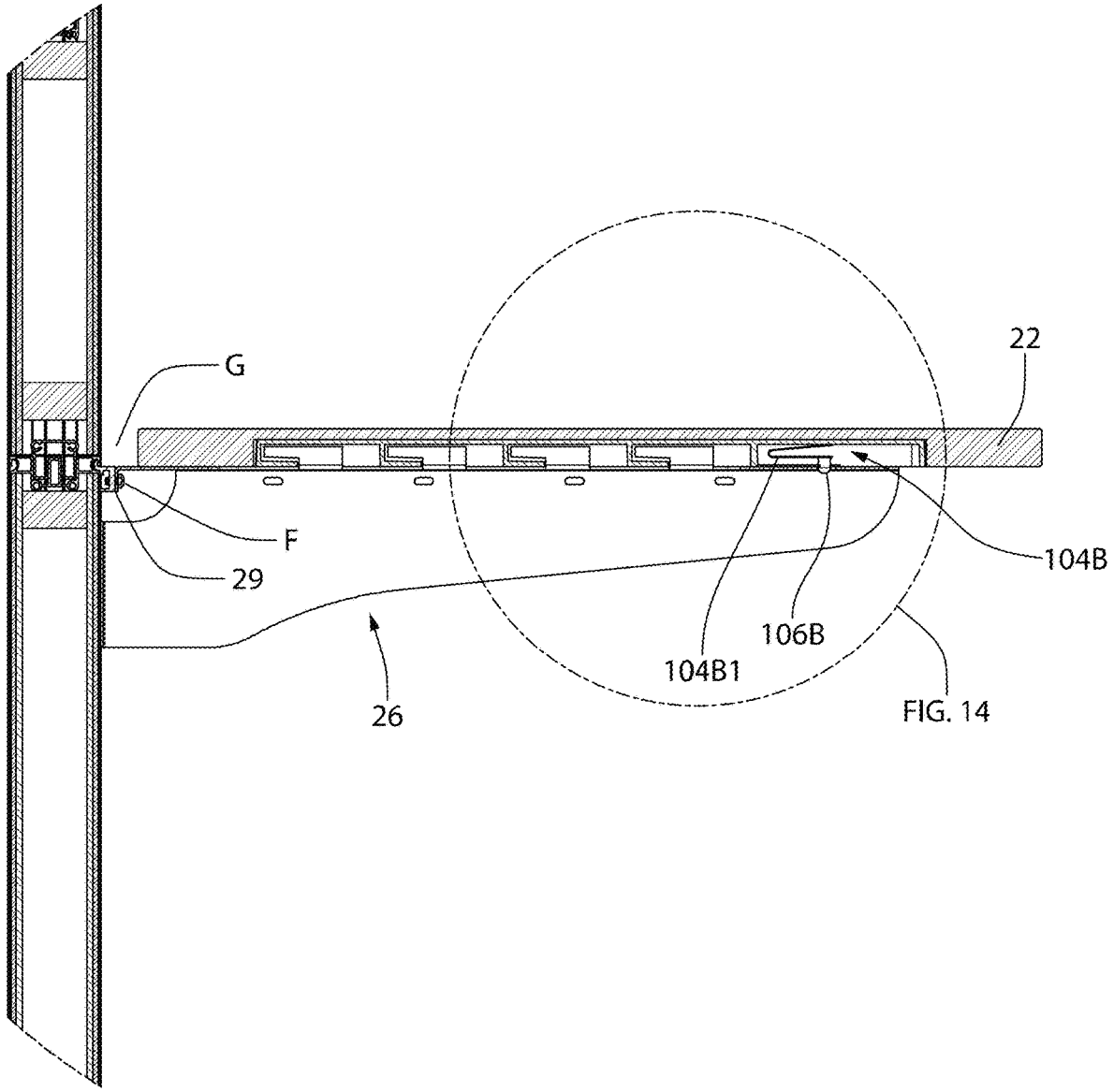
FIG. 13 is an enlargement of the circled portion of the inventive releasable desktop apparatus of FIG. 12.
Figure 14:
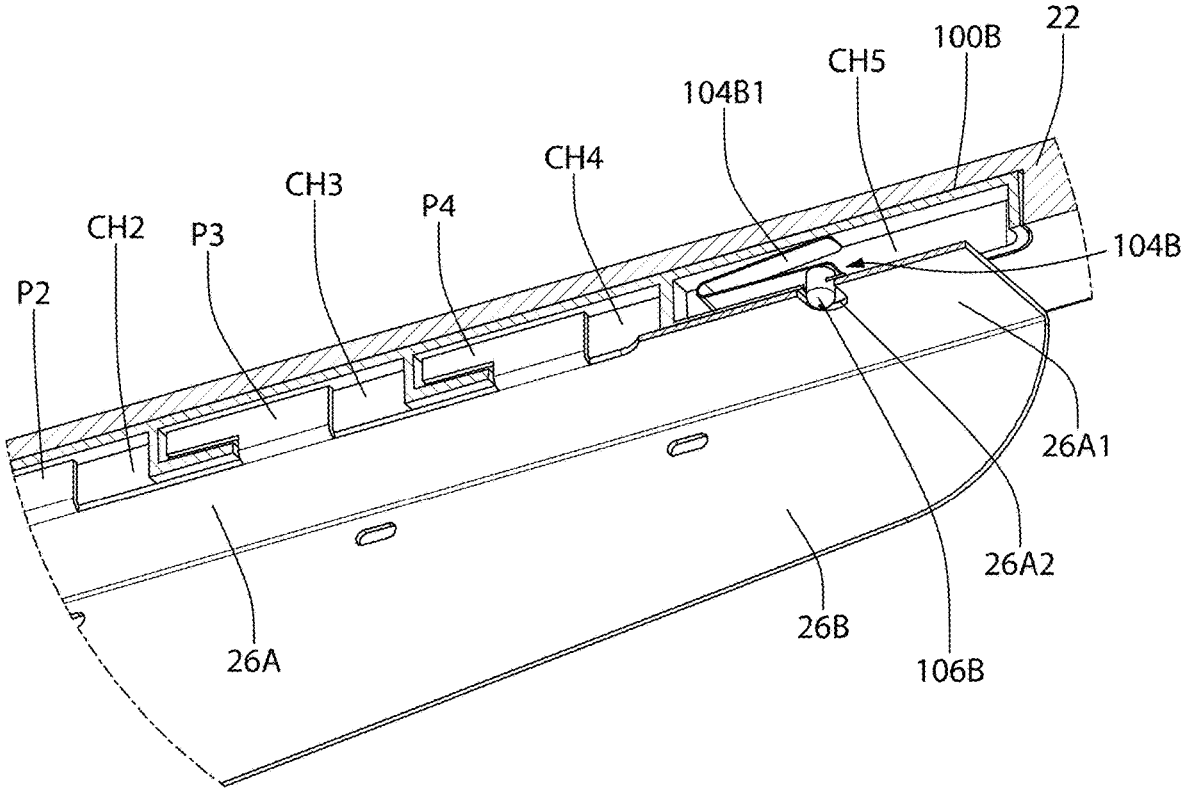
FIG. 14 is a partial cross-sectional isometric view of the right-side support bracket locked into the right receptacle bracket of the desktop element.
Figure 15:
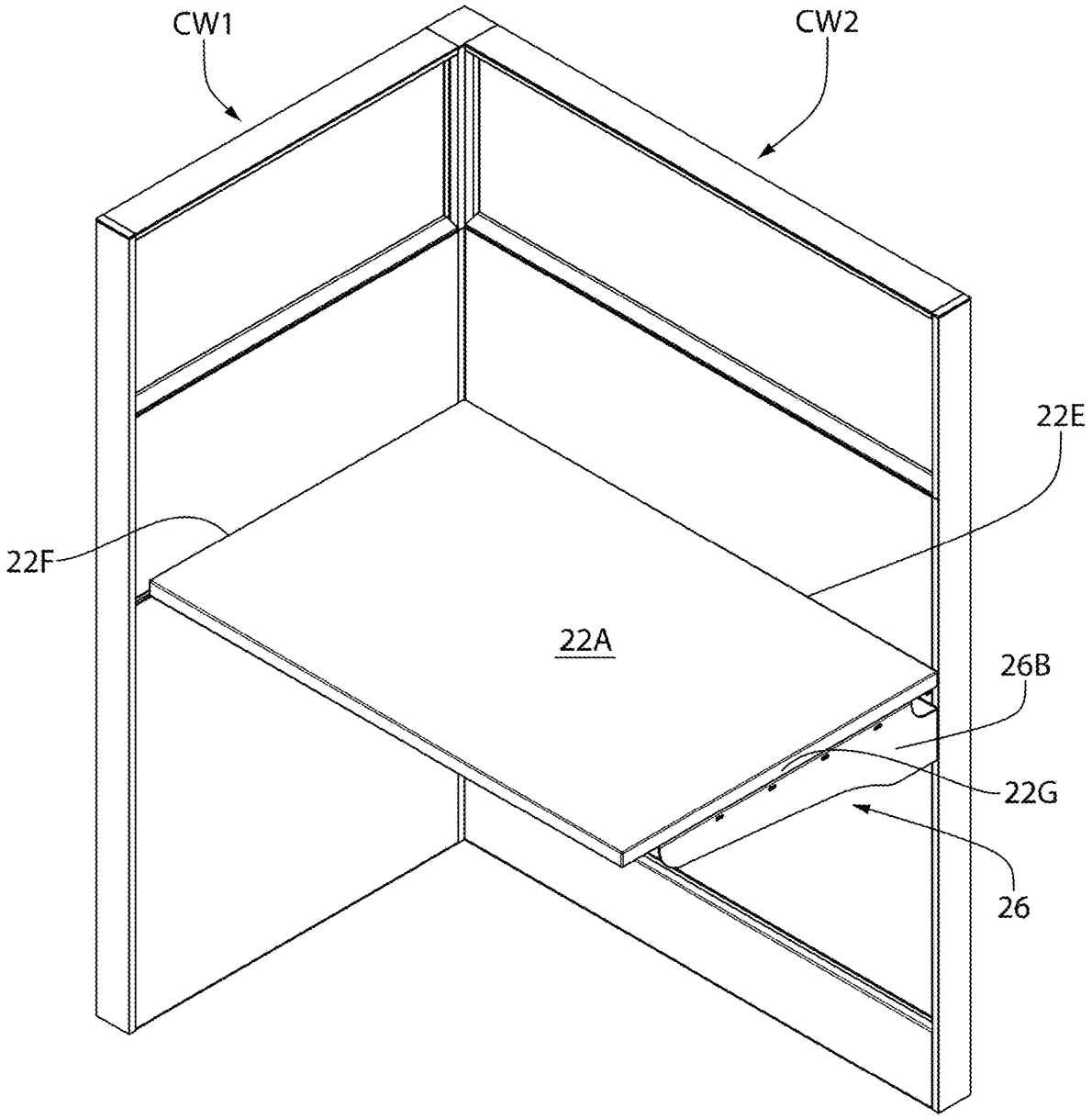
FIG. 15 is a top isometric view of an inside corner of the modular business cubicle showing the inventive releasable desktop apparatus with the desktop element positioned therein and not yet locked in place.
Figure 16:
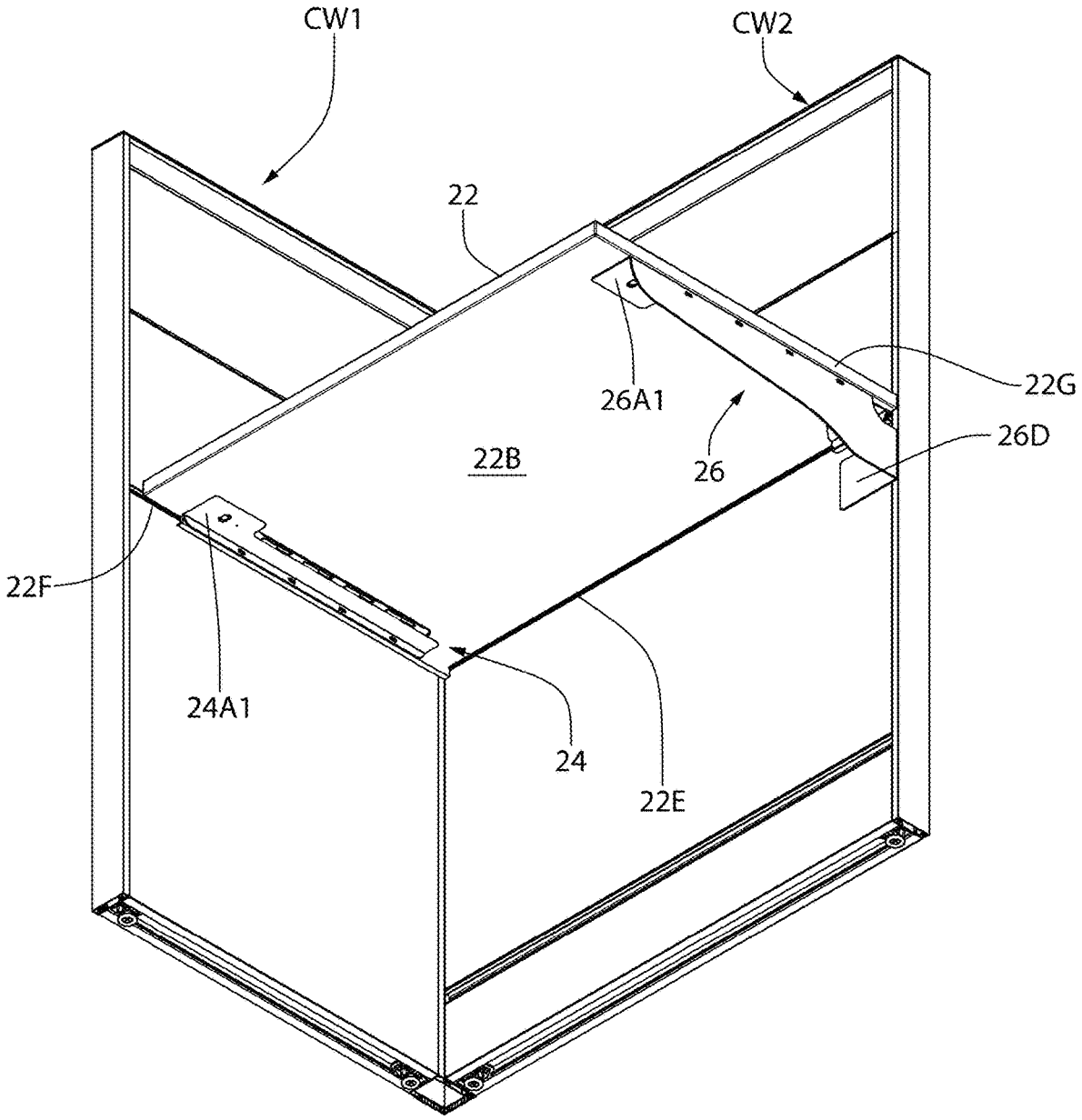
FIG. 16 is a bottom isometric view of an inside corner of the modular business cubicle showing the inventive releasable desktop apparatus of FIG. 2 with the desktop element positioned therein and not yet locked in place.
Figure 17:
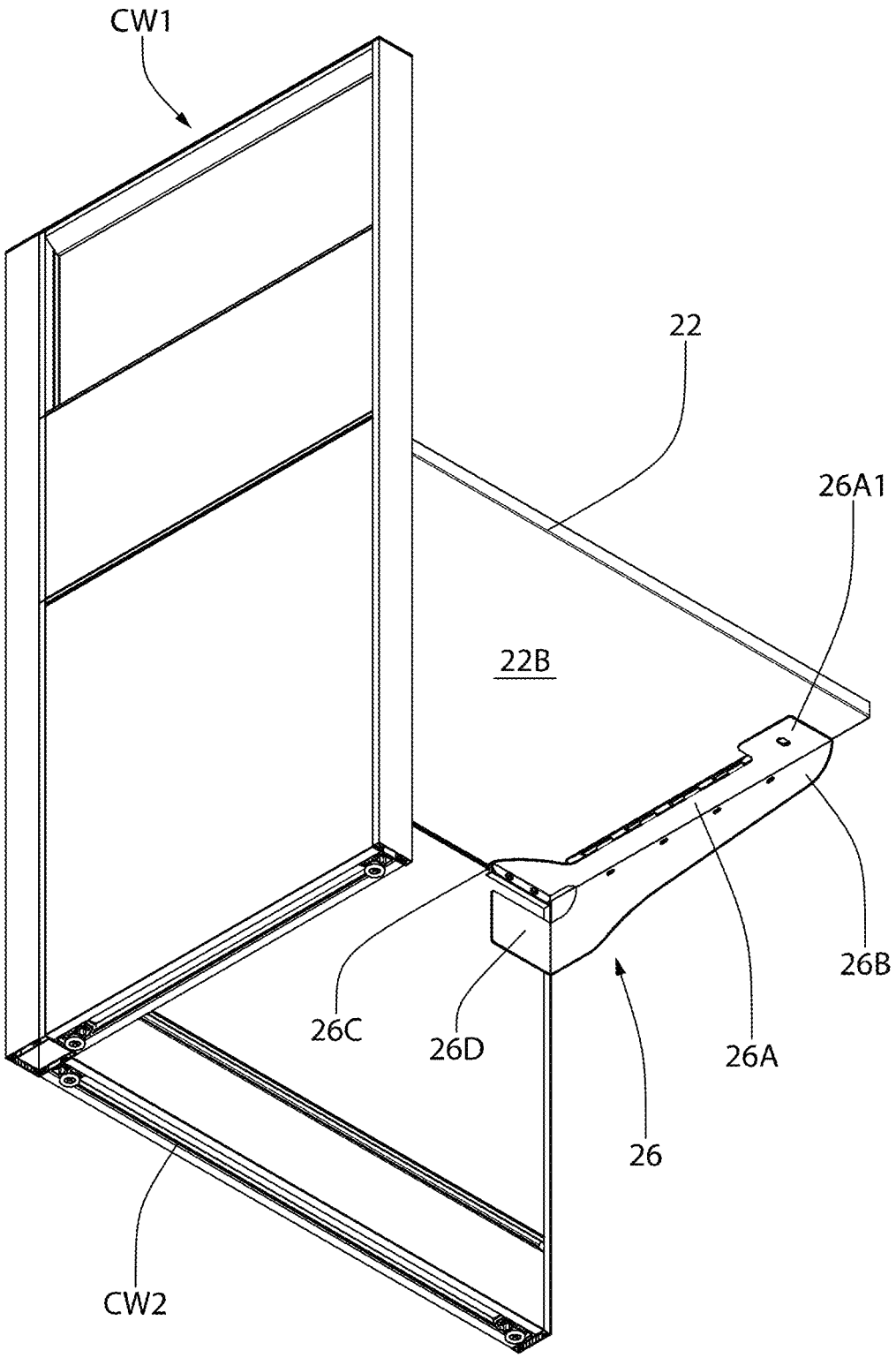
FIG. 17 is a bottom isometric view of the right underside of the inventive releasable desktop apparatus of FIG. 15 with the desktop element positioned therein and not yet locked in place.
Figure 18:
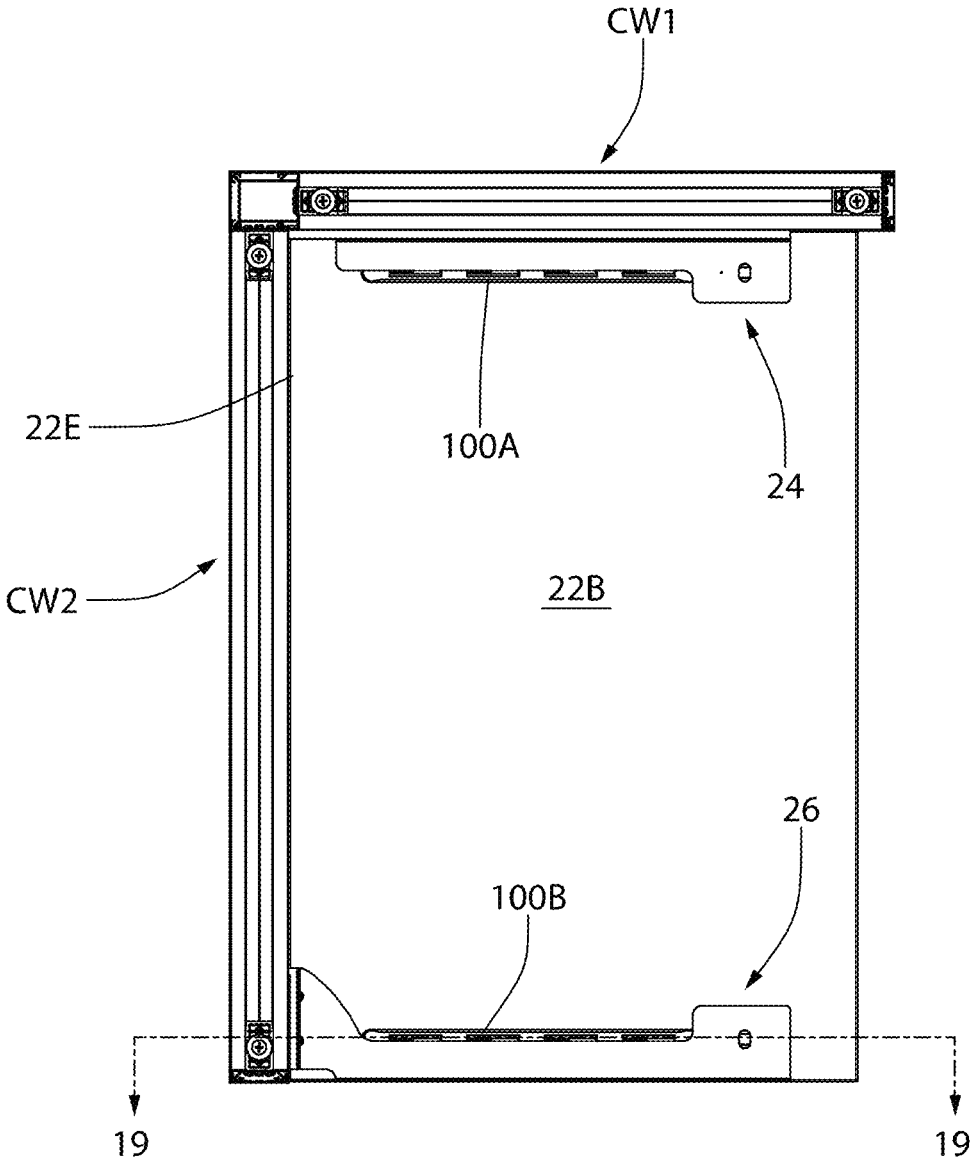
FIG. 18 is a bottom plan view of the inventive releasable desktop apparatus of FIG. 15 with the desktop element positioned therein and not yet locked in place.
Figure 19:
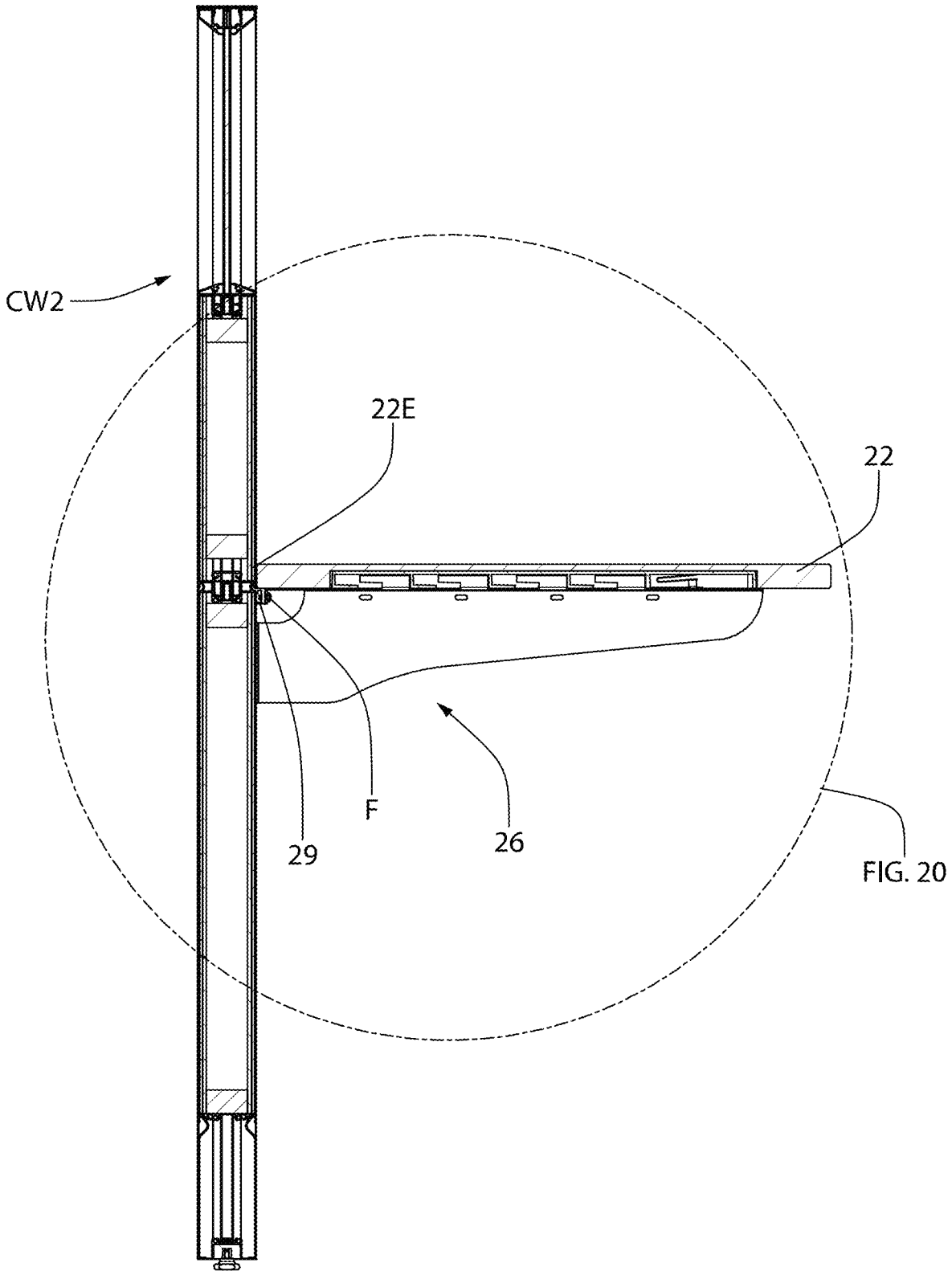
FIG. 19 is a cross-sectional view taken along line 19-19 of FIG. 18 of the right-side support bracket connected to the right receptacle bracket but not yet locked in place.
Figure 20:
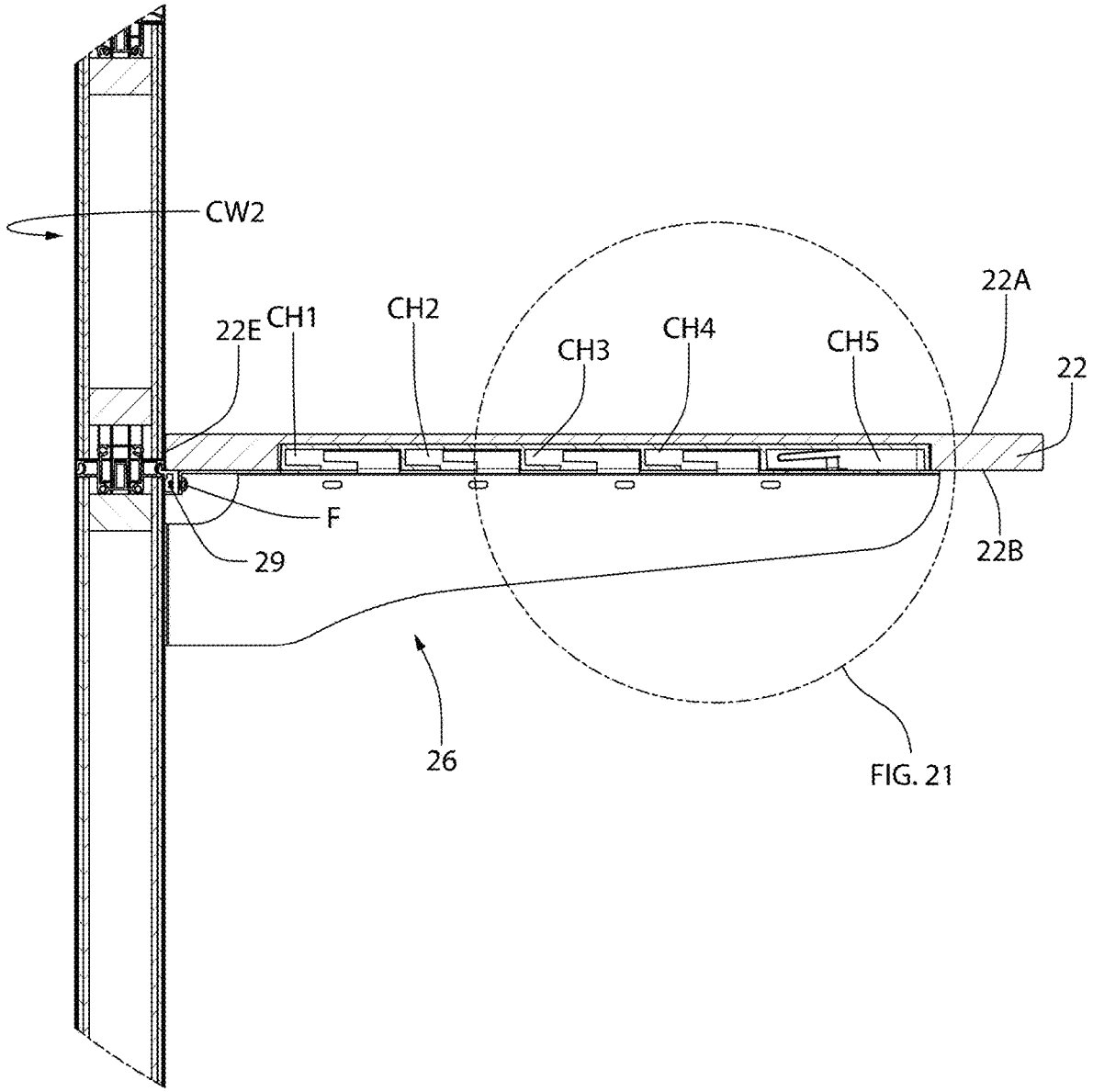
FIG. 20 is an enlargement of the circled portion of FIG. 19 showing the right receptacle bracket coupled with the right-side support bracket but not yet locked in place.

As shown most clearly in FIG. 9, a shorter C-shaped mounting bracket 29 is used to secure the RSSB 26. In particular, the C-shaped mounting bracket 29 also has a lip 29A (FIG. 10) that is inserted in between two vertically-connected tiles T3/T4. With that lip 29A trapped between the two tiles T3/T4, the C-shaped mounting bracket 29 also provides a "standoff surface" 29B for receiving fasteners F (e.g., screws) therethrough. As shown in FIG. 10, the standoff surface 29B comprises a plurality of apertures A. When the RSSB 26 is to be secured to the cubicle wall CW2, oval-shaped apertures OA in the upper vertical flange 26C are aligned with the bracket apertures A and the fasteners F secured therein. The oval-shaped apertures OA allow for horizontal adjustment of the RSSB 26. Furthermore, the lower vertical flange 26D acts to transfer the loading applied to the desktop element 22 on the right side thereof to the cubicle wall CW2.

To releasably secure the desktop element 22 to the LSSB 24 and the RSSB 26 once those two brackets are secured to the cubicle walls CW1 and CW2, the user/operator will position the bottom side 22B of the desktop element 22 over the two brackets 24/26 with the forward end 22E of the desktop element 22 up against the cubicle wall CW2, as shown in FIGS. 15-21. With the forward end 22E of the desktop element 22 against the cubicle wall CW2, the user/operator will seat all of the L-shaped prongs P1-P4 of both brackets 24/26 into corresponding chambers CH1-CH4 of the receptacle brackets 100A/100B in the bottom side 22B of the desktop element 22. At that point, the release buttons 106A/106B are compressed upward since the extensions 24A1 and 26A1 are compressing the release devices 104A/104B in the receptacle brackets 100A/100B. The user/operator then pulls back on the desktop element 22, thereby moving the forward edge 22E away from the cubicle wall CW2 and this backward movement causes the release buttons 106A/106B to seat themselves in the respective apertures 24A2/26A2 of the cantilever brackets 24/26, thereby releasably securing the desktop element 22 on the two support brackets 24/26. In doing so, a gap G is created between the forward edge 22E of the desktop element 22 and the cubicle wall CW2, as shown in FIGS. 2-3 and 11-14. An elongated tray (not shown) can be inserted into the gap G to prevent writing implements or other items from falling over the forward edge 22E and onto the floor.

Conversely, to disengage the desktop element 22 from the two support brackets 24/25, the user would depress the release buttons 106A/106B upward and then slide the desktop element 22 forward (so that forward edge 22E contacts wall CW2) and then lift the desktop element 22 upward to disengage the desktop element 22 from the support brackets 24/26.

FIG. 26 depicts the desktop apparatus 20 releasably mounted on a cubicle wall (formed by two serial cubicle walls CW2 and CW3). Since there is no "corner" in this mounting, the left-side support bracket requires a cantilever structure, similar to RSSB 26. As such, the left-side support bracket 124 is a "mirror" structure of RSSB 26 but for use on the left side 22F of the desktop element 22. In particular LSSB 124 comprises a horizontal flange 124A and a vertical flange 124B. In addition, since the left side 22F of the desktop element 22 is now also "open", releasable securement of the cantilever LSSB 124 is implemented vial a perpendicular forward portion comprising an upper vertical flange 124C and a lower vertical flange 124D. Although not clearly shown, a C-shaped mounting bracket, having an upper lip and "standoff surface", similar to the C-shaped mounting bracket 29 used with the RSSB 26, is used along with fasteners to releasably couple the LSSB 124 to the cubicle wall.

It should be further noted that if the desktop element 22 were to be releasably positioned in the modular cubicle MBC such that the right side 22G of the desktop element 22 were located in a cubicle corner, then a "mirror" bracket of LSSB 24 would be used to engage with receptacle bracket 100B to releasably secure the right side 22G within that cubicle corner and the LSSB 124 would be used to engage with receptacle bracket 100A to releasably secure the left side 22F of the desktop element 22 at that corner of the cubicle MBC.

Releasably-Locked Furniture

It is also desirable to use the releasable locking mechanism (RLM) of the releasable desktop in furniture in general (and also referred to as "furniture piece") to make their assembly, and dis-assembly, easier and more efficient. Thus, by way example the releasable locking mechanism can be used with conference tables, desks, desking systems (i.e., where multiple desks attach together with dividers to create a shared workspace), workbenches, coffee tables, end tables, café tables (e.g., lunch tables), training tables, reception desks, etc.

Figure 27:
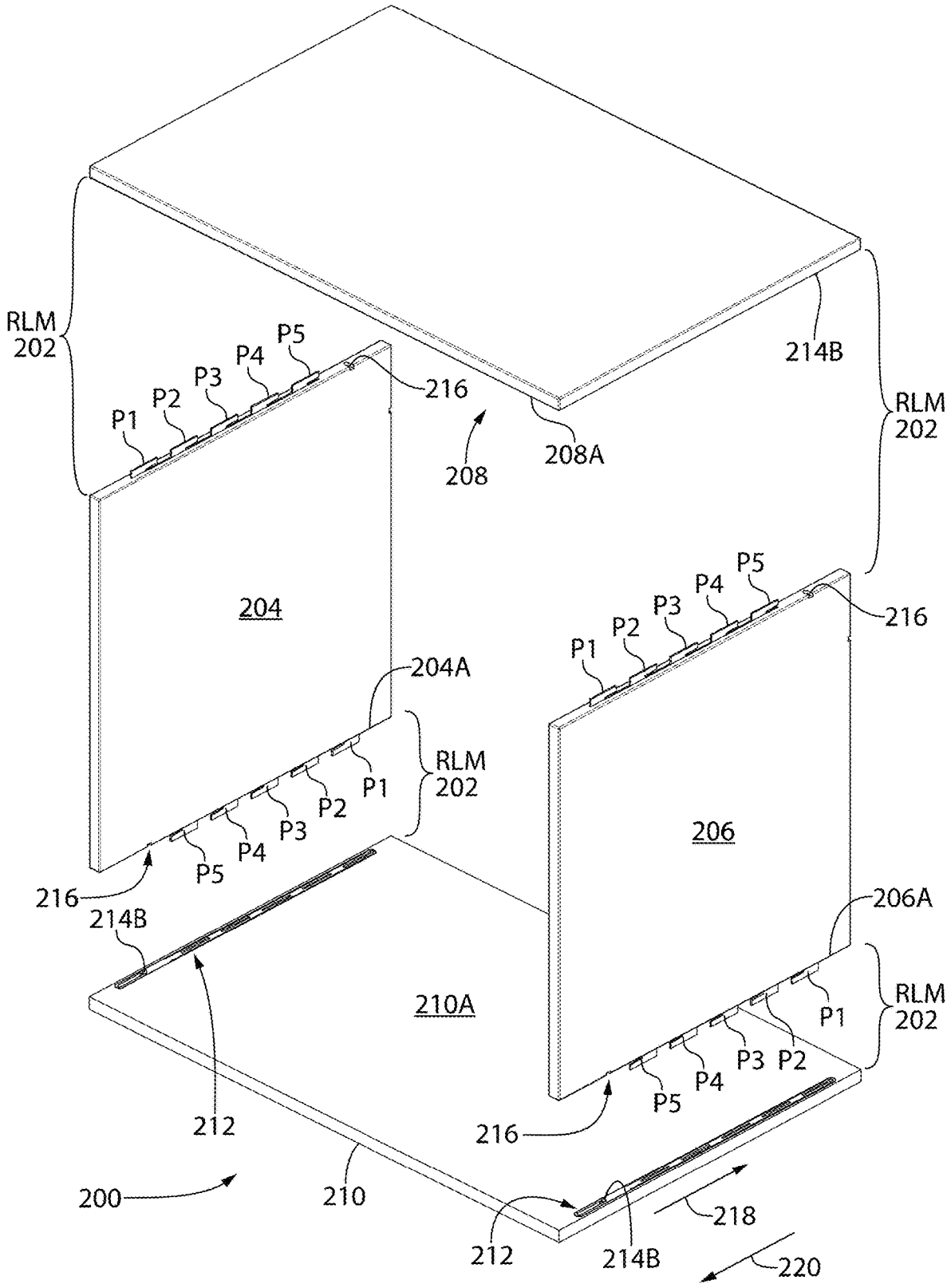
FIG. 27 is an exploded view of an exemplary furniture piece using the inventive releasable locking mechanism.
Figure 28:
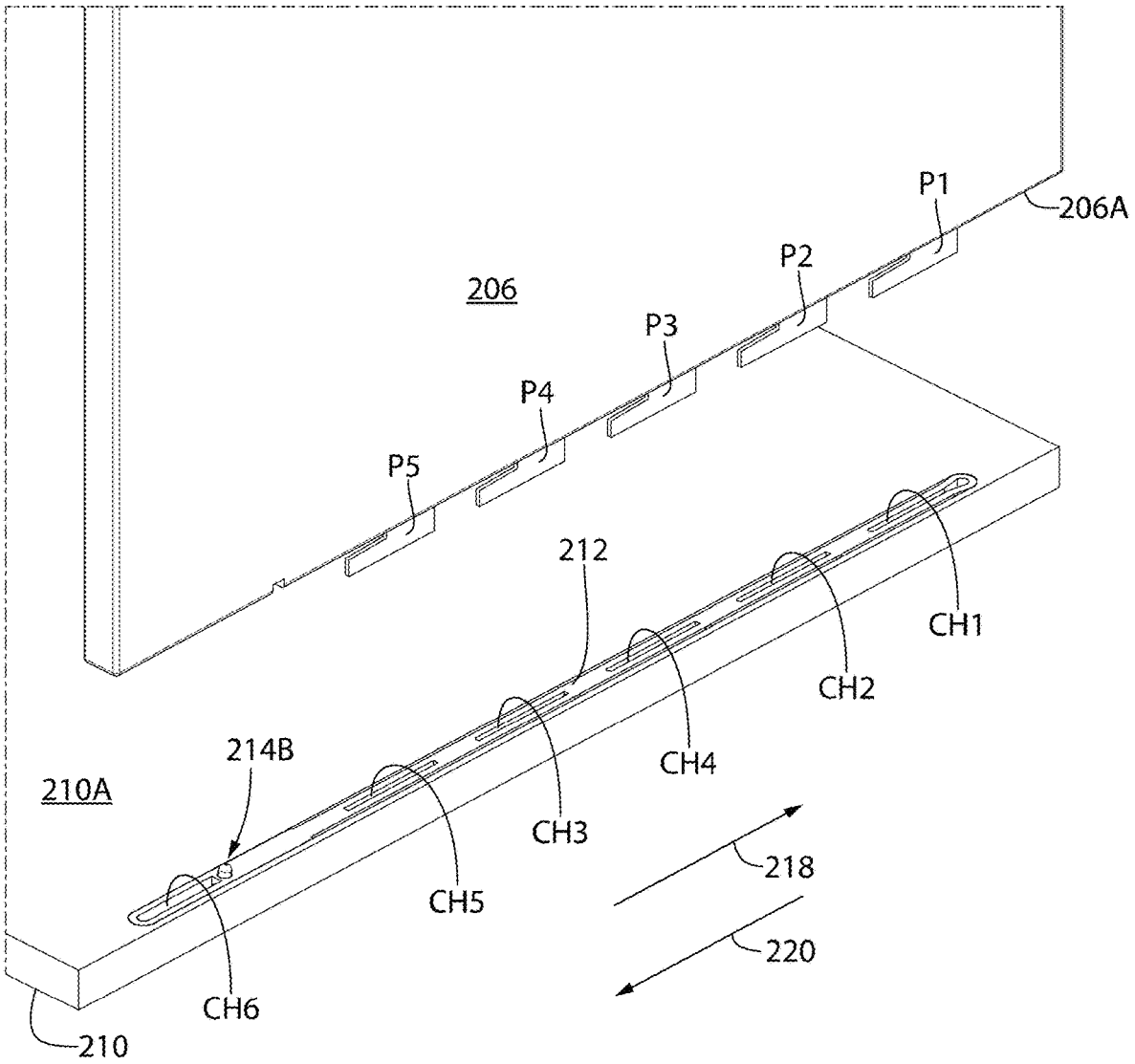
FIG. 28 is an enlarged partial isometric and exploded view of the lower region of one furniture component and another furniture component (e.g., a sidewall and a base panel of FIG. 27), depicting a receptacle bracket with its plurality of chambers and release device on one furniture component and of the corresponding plurality of projections on the another furniture component.
Figure 29:
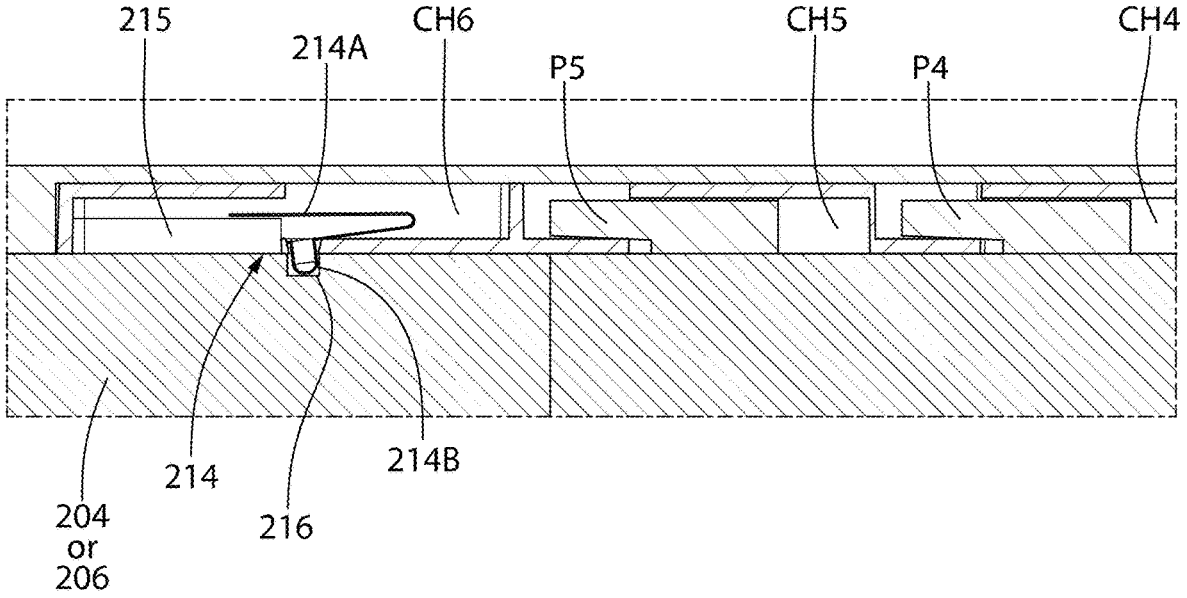
FIG. 29 is an enlarged partial side view of two projections seated within the corresponding chambers of the receptacle bracket and showing the release button seated in a cavity.

To that end, FIGS. 27-29, depict a cabinet-style furniture 200, by way of example only, to disclose the application of the releasable locking mechanism (RLM) 202. This is by way of example only and is not meant to limit the use of the RLM 202 to that specific type of furniture. The important feature is the ability to releasably secure furniture parts together using the RLM 202.

As can be seen in FIG. 27, the furniture 200 comprises a pair of sidewalls 204 and 206 and having a top panel 208 and a base panel 210. The top and bottom edges of both panels 204/206 comprise the plurality of projections P1-P5 which are serially-aligned. As with the original invention 20, the present invention RLM 202 is not limited to five projections P1-P5; rather the number of projections is by way of example only. Consequently, there is a corresponding receptacle bracket 212 (which is very similar to the receptacle brackets (100A/100B) in the prior invention 20) on the corresponding edges of the inward-facing sides 208A and 210A of the top panel 208 and the bottom panel 210, respectively. Thus, as can be seen most clearly in FIGS. 28, chambers CH1-CH5, also serially-aligned, are present in the receptacle bracket 212. And as mentioned previously with regard to receptacle brackets 100A/100B, the receptacle bracket 212 is fixedly pressed and secured inside a groove (not shown) so that the receptacle bracket 212 forms a smooth contour with the bottom surfaces 208A/210A.

As with the invention 20, the present invention of the RLM 202 also has a release device 214 (FIG. 29) that is located within an additional chamber, namely, a sixth chamber, CH6. The release device 214 comprises a small V-shaped leaf spring 214A with a release button 214B on one end of the V-shaped leaf spring 214A; and this entire release device 214 is positioned within chamber CH6 (FIG. 28). There is also a protuberance 215 (FIG. 29) located inside chamber CH6; the other end of the V-shaped leaf spring 214A (i.e., the side of the spring 214A without the release button 214B is secured (e.g., via an adhesive, fastener, etc.) to the top of this protuberance 215. However, since there are no "support brackets" as there were in the invention 20, a small cavity 216 (FIGS. 29 and 30) is formed in the edge where the corresponding projections P1-P5 are located, namely after projection P5 (see FIG. 27). As with the release devices 104A/104B, the leg of the V-shaped leaf spring 214A with the release button 214B thereon is biased away from the chamber CH6 and thus can freely move (e.g., in/out, up/down, etc.)

It should be noted that the orientation of the projections P1-P5 on the top of sidewalls 204/206 and the bottom sidewalls 204/206 are reversed. This is done to connect the sidewalls 204/206 to either the top panel 208 first and then the base panel 210 second, or vice versa. Thus, by way of example only, if the sidewalls 204/206 are to be releasably secured to the base panel 210 first, the projections P1-P5 on the bottom edges of sidewalls 204/206 are first inserted into their corresponding chambers CH1-CH5 of the corresponding receptacle bracket 212 in the base panel 210. FIG. 28 depicts the bottom edge of the sidewall 206 and one edge of the base panel 210. In particular, the projections P1-P5 are inserted into the corresponding channels CH1-CH5 and then the sidewall 206 is slid in the direction 220 or the base panel 210 is slid in the direction 218. Either way, during this sliding step, the release button 214B remains compressed inward within chamber CH6, against the bias of the V-shaped leaf spring 214A. As the sidewall 204 or 206 continues to slide in the direction 220, or the base panel 210 slide in the direction 218, (see FIGS. 27-28) the projections P1-P5 slide fully into their corresponding chambers CH1-CH5, and the release button 214B will "seat" itself into the cavity 216 due to the bias of the V-shaped leaf spring 214A, thereby halting any further relative movement of these furniture components and releasably locking the sidewalls 204 and 206 to the base panel 210.

As similar process is carried out for attaching the top edges of the sidewalls 204/206 to the top panel 208. The only difference is that because the orientation of the projections P1-P5 and the corresponding channels CH1-CH5 in the receptacle brackets 212 in the top panel surface 208A are reversed, either the sidewalls 204/206 are slid in the direction 218 or the top panel 208 is slid in the direction 220.

It should be understood that once the projections P1-P5 are inserted into their corresponding chambers CH1-CH5, to releasably lock the sidewalls 204/206 to the top panel 208 or base panel 210, the sidewalls 204/206 are always slid in the direction towards the release button 214B while the top panel 208 or base panel 210 are slid in the opposite direction; conversely, to release the sidewalls 204/206 from the top panel 208 or base panel, once the release button 214 is depressed, the sidewalls 204/206 are always slid away in a direction away from the release button 214B while the top panel 208 or base panel 210 are slid in the opposite direction. And as mentioned previously, the mating surfaces can be simultaneously slid in opposite directions.

In particular, to release the top panel 208 and/or the base panel 210 from the corresponding sidewalls 204/206, the opposite process is followed. Firstly, the user will feel for the release button 214B which is seated in the cavity 216; the cavity 216 exposes a portion of the release button 214B to allow the user to depress the release button 214B against the bias of the V-shaped leaf spring 214A and then the sidewall (s) 204 and 206 are slid in a direction away from the release button 214B (FIGS. 27-28) and then the sidewalls 204/206 can be lifted out of the receptacle brackets 212.

Figure 30:
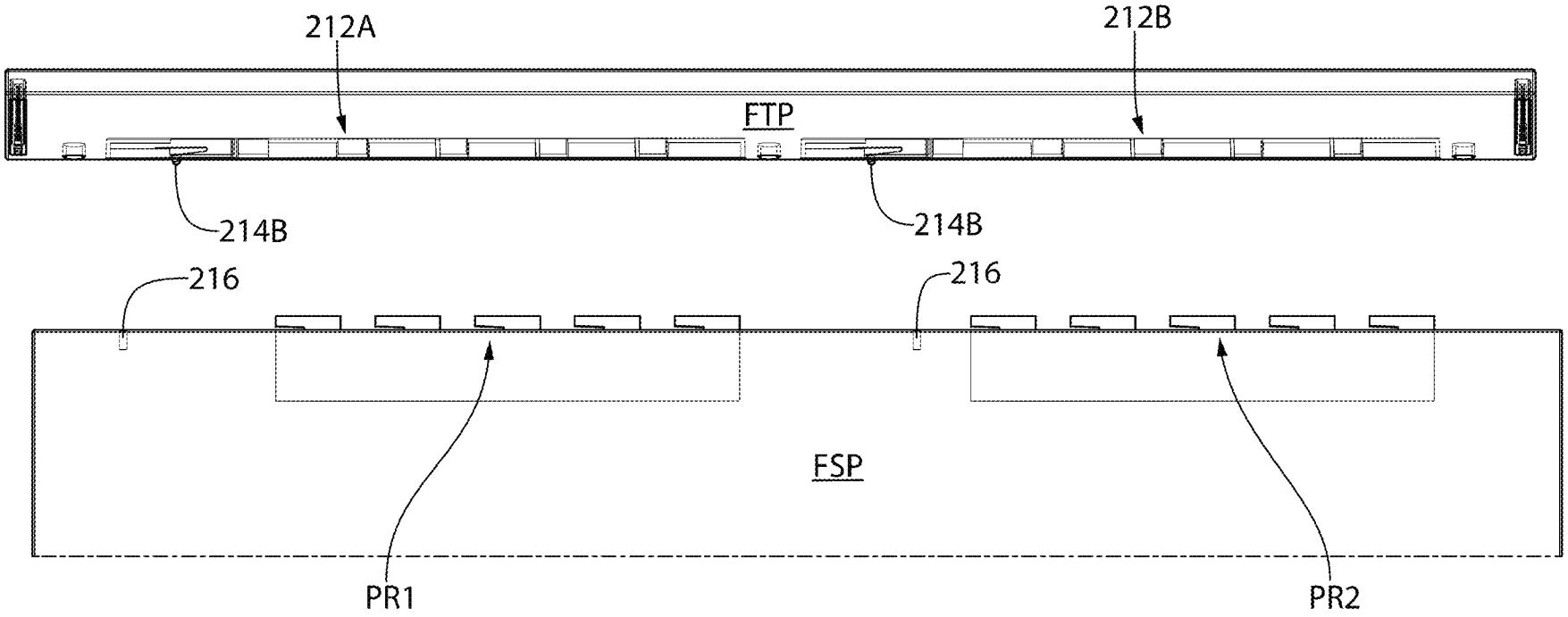
FIG. 30 is another exemplary furniture piece, in an exploded view, showing two pluralities of projections, and associated cavities, on a first furniture component and a corresponding pair of receptacle brackets, having their associated release devices/release button, shown on a second furniture component.
Figure 31:
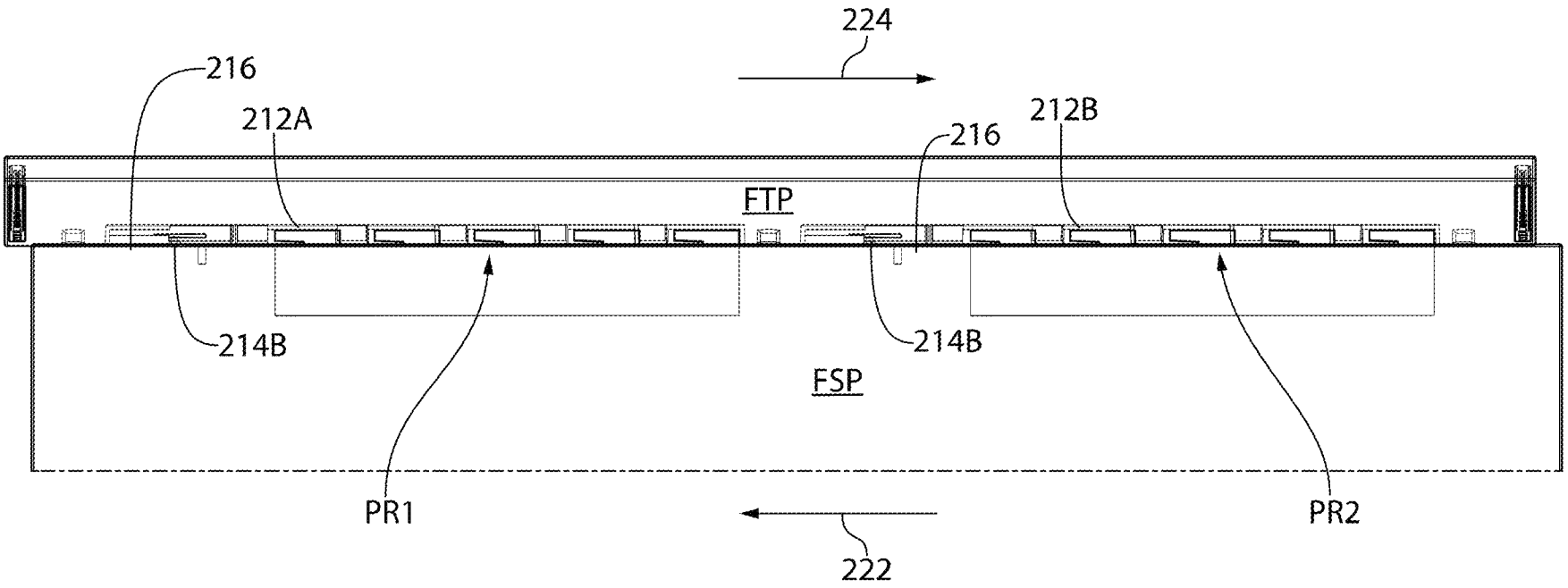
FIG. 31 shows the two furniture components of FIG. 30 engaged but not yet releasably secured together.
Figure 32:
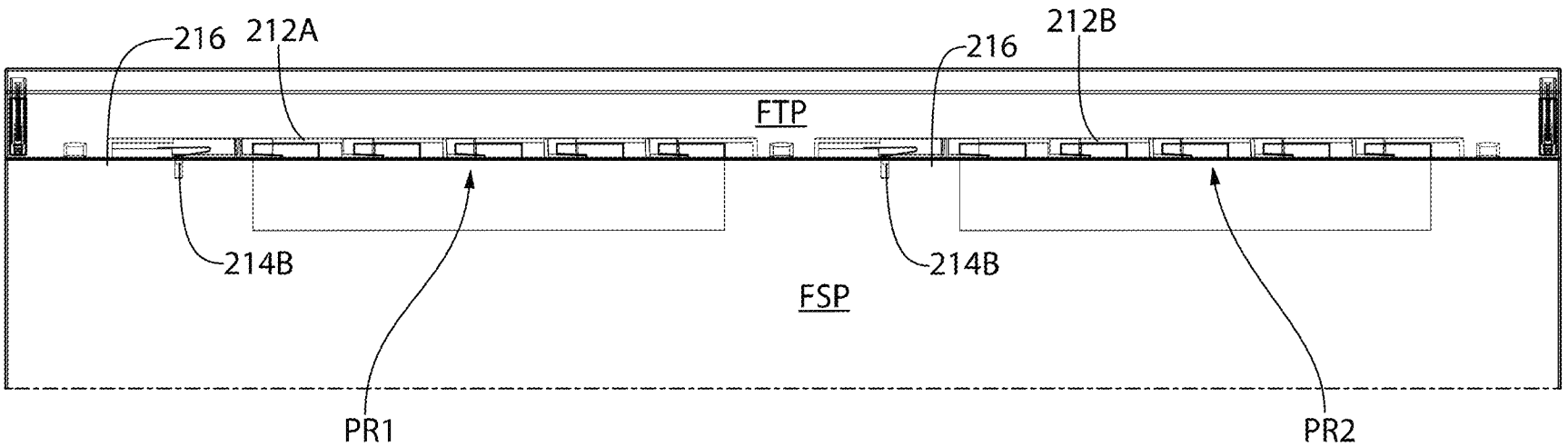
FIG. 32 shows the two furniture components of FIG. 30 releasably secured together, with the projections moved fully within their corresponding chambers and the release buttons seated in their respective cavities.

FIGS. 30-32 show another RLM 22 configuration with two sets of projections PR1 and PR2 being positioned on the top edge of the long side of the furniture side panel FSP. Corresponding receptacle brackets 212A and 212B are located on the corresponding long edge of a furniture top panel FTP. Cavities 216 are also provided in the top edge of the long side of the furniture side panel FSP for seating the respective release buttons 214B from the receptacle brackets 212A and 212B. The same procedure discussed above for releasably assembling and disassembling the top panel FTP from the side panel FSP is used here also.

In particular, in FIG. 30, the projections PR1 and PR2 on the edge of the FSP are aligned with the corresponding channels in receptable brackets 212A and 212B, respectively, on the edge of the FTP. Next, the projections PR1 and PR2 are inserted into the respective receptacle brackets 212A and 212B and the FSP is partially slid in the direction 222 (or, the FTP is partially slid in the opposite direction 224); as shown, this partial sliding process depresses the release button 214B. And, as shown in FIG. 32, when the FSP is completely slid in the direction 222 (or the FTP is completely slid in the direction 224), the release buttons 214B "seat" into their respective cavities 216, thereby releasably locking the FSP and the FTP together. Conversely, to detach the FTP from the FSP, the reverse process is followed.

While the invention has been described in detail and with reference to specific examples thereof, it will be apparent to one skilled in the art that various changes and modifications can be made therein without departing from the spirit and scope thereof.

What is claimed is:

1. A releasable locking apparatus for releasably locking two components of furniture together, said apparatus comprising:

a plurality of projections located on an edge of a first component, said plurality of projections being serially-aligned, said edge also comprising a cavity therein;

a receptacle bracket comprising a plurality of serially-aligned chambers corresponding to said plurality of projections, said receptacle bracket secured within a surface of a second component;

a release device positioned in an additional chamber, separate from said plurality of chambers, in said receptacle bracket, said release device comprising a release button that is biased away from said additional chamber; and wherein said plurality of serially-aligned chambers are configured to receive said plurality of projections therein and allowing said plurality of projections to slide within their respective chambers when said first and second components are slid with respect to each other, thereby compressing said release button against said edge and halting said sliding when said release button seats within said cavity to releasably lock said first and second components together.

2. The releasable locking apparatus of claim 1 wherein each of said projections is an L-shaped projection.

3. The releasable locking apparatus of claim 1 wherein said release device comprises a V-shaped leaf spring, and wherein a first leg of said V-shaped leaf spring is secured within said additional chamber and said release button is secured on a second leg of said V-shaped leaf spring, said second leg being free to move.

4. A furniture piece formed by components that are releasably secured together, said furniture piece comprising:

a first component having a receptacle bracket provided along an edge thereof, said receptacle bracket comprising a plurality of chambers;

a second component having a plurality of projections along an edge thereof, said plurality of projections corresponding to said plurality of chambers in said receptacle bracket; and a release device positioned within said receptacle bracket and comprising a release button that is biased away from said receptacle bracket, said release button configured to ride along said edge having said plurality of projections thereon when said plurality of projections is inserted into said corresponding plurality of chambers and said second component is moved in a first direction such that said projections are moved within their respective chambers, said movement halted when said release button seats within a cavity formed into said edge having said plurality of projections thereon, thereby releasably locking said first and second components together.

5. The furniture piece of claim 4 wherein said plurality of chambers are serially aligned and wherein said plurality of projections are serially aligned.

6. The furniture piece of claim 5 wherein said release device is positioned within a chamber that is on one end of said releasable bracket, said one end being a receptacle bracket end to which said first direction is directed.

7. The furniture piece of claim 5 further comprising:

a second receptacle bracket along another edge of said first component, said second receptacle bracket having a second release device with a second release button;

another plurality of projections, corresponding to said plurality of chambers in said second receptable bracket, along an edge of a third component, said edge of said third component also comprising a second cavity configured for receiving said second release button therein;

said second release button configured to ride along said edge of said third component and when said another plurality of projections are inserted into said corresponding plurality of chambers of said second receptacle bracket and said at third component is moved in a second direction such that said projections are moved within their respective chambers, until said second release button encounters and then seats within said second cavity:

said first and third components being releasably locked together when said second release button seats itself into said second cavity.

8. The furniture piece of claim 7 wherein said second receptacle bracket is embedded in said first component such that said plurality of chambers are flush with one side of said first component.

9. The furniture piece of claim 5 wherein said plurality of projections comprises L-shaped projections.

10. The furniture piece of claim 4 wherein each of said releasable lock comprises a V-shaped leaf spring, with one member of the V-shaped leaf spring secured within said receptacle bracket and the other member of the V-shaped leaf spring being free to move and comprises said release button positioned on an end of said other member.

11. The furniture piece of claim 4 wherein said plurality of projections comprises L-shaped projections.

12. The furniture piece of claim 4 wherein said receptacle bracket is embedded within said first component so that said plurality of chambers are flush with said one side of said first component.

13. The furniture piece of claim 4 wherein said plurality of projections are L-shaped and oriented in said first direction, and wherein said second component comprises a second edge, opposite to said edge having said plurality of projections thereon, said second edge comprising a corresponding plurality of L-shaped projections but oriented in a direction opposite to said first direction, said second edge further comprising a second cavity.

14. The furniture piece of claim 13 further comprising:

a third component having another receptacle bracket positioned therein, said another receptacle bracket comprising a plurality of channels therein, said plurality of channels in said another receptacle bracket corresponding to said plurality of L-shaped projections oriented in said direction opposite to said first direction; and a second release device positioned within said another receptacle bracket and comprising a second release button, said second release button remaining compressed when said plurality of L-shaped projections oriented in said direction opposition to said first direction is inserted into said corresponding plurality of channels and slid in said direction opposite to said first direction;

said second and third components being releasably locked together when said second release button seats itself into said second cavity.

15. A method for releasably assembling a furniture piece having at least two components, said method comprising:

forming a receptacle bracket along an edge of a first component, said receptacle bracket comprising a plurality of chambers and including a release device having a release button that can be displaced and is biased away from said receptacle bracket;

forming a plurality of projections, corresponding to said plurality of chambers, along an edge of a second component, said edge of said second component also comprising a cavity configured for receiving said release button therein;

inserting said plurality of projections into said plurality of chambers; and sliding said first component or said second component with respect to the other component so that said release button is compressed as it rides against said edge of said second component until it seats into said cavity, thereby releasably locking said first and second components together.

16. The method of claim 15 wherein said step of forming said receptacle bracket comprises forming said plurality of chambers to be serially aligned and wherein said step of forming said plurality of projections comprises forming said plurality of projections to be serially aligned.

17. The method of claim 16 wherein said step of forming said step of including said release button comprises inserting a V-shaped leaf spring within said receptacle bracket to form said release device, said step of inserting comprising securing one member of said V-shaped leaf spring within said receptacle bracket and allowing said other member of said V-shaped leaf spring to move freely and wherein said release button is positioned on an end of said other member.

18. The method of claim 16 further comprising the steps of:

forming a second receptacle bracket along another edge of said first component, said second receptacle bracket having a second release device with a second release button;

forming another plurality of projections, corresponding to said plurality of chambers in said second receptable bracket, along an edge of a third component, said edge of said third component also comprising a second cavity configured for receiving said second release button therein;

inserting said plurality of projections along said edge of said third component into said plurality of chambers in said second receptacle bracket; and sliding said third component or said first component with respect to the other component so that said second release button is compressed as it rides against said edge of said third component until it seats into said second cavity, thereby releasably locking said first and third components together.

19. The method of claim 16 wherein said step of forming said receptacle bracket comprises positioning said release device within a chamber in said receptacle bracket that is positioned adjacent an end of said receptacle bracket, said end being a receptable bracket end towards which said third component is moved.

20. The method of claim 15 wherein said plurality of projections comprises L-shaped projections.

21. The method of claim 15 wherein said step of forming said receptacle bracket comprises embedding said receptacle bracket within said first component so that said plurality of chambers are flush with said one side of said first component.

22. The method of claim 15 further comprising the step of releasing said first and second components, said step of releasing said first and second components comprising:

(a) depressing said release button toward said releasable bracket;

(b) sliding said first or second component away from the other component; and (c) pulling said first and second components away from each other.

23. The method of claim 15 wherein said plurality of projections are L-shaped and oriented in a first direction, and wherein said second component comprises a second edge, opposite to said edge having said plurality of projections thereon, said second edge comprising a corresponding plurality of L-shaped projections but oriented in a direction opposite to said first direction, said second edge further comprising a second cavity.

24. The method of claim 23 further comprising the steps of:

providing a third component having another receptacle bracket positioned therein, said another receptacle bracket comprising a plurality of channels therein, said plurality of channels in said another receptacle bracket corresponding to said plurality of L-shaped projections oriented in said direction opposite to said first direction;

positioning a second release device within said another receptacle bracket and comprising a second release button;

inserting said plurality of L-shaped projections on said second edge into said corresponding plurality of channels in said another receptacle bracket;

sliding said third component in said first direction so that said second release button is compressed as it rides against said second edge until it seats into said second cavity, thereby releasably locking said second and third components together.

25. A method of releasably locking two components of furniture together, said method comprising:

providing a plurality of projections on an edge of a first component and which are serially-aligned and forming a cavity within said edge;

embedding a receptacle bracket within a surface of a second component and wherein said bracket comprises a plurality of serially-aligned chambers corresponding to said plurality of projections;

positioning a release device in an additional chamber, separate from said plurality of chambers, in said receptacle bracket and including a release button in said release device that is biased away from said additional chamber;

inserting said plurality of projections within said corresponding plurality of chambers; and sliding said first component with respect to said second component causing said plurality of projections to slide within their respective chambers and thereby compressing said release button against said edge and halting said sliding when said release button seats within said cavity to releasably lock said first and second components together.

26. The method of claim 25 wherein each of said projections is an L-shaped projection.

27. The method of claim 26 wherein said release device comprises a V-shaped leaf spring, and wherein a first leg of said V-shaped leaf spring is secured within said additional chamber and said release button is secured on a second leg of said V-shaped leaf spring, said second leg being free to move.

* * * * *